US008150612B2

(12) United States Patent
Nagase et al.

(10) Patent No.: US 8,150,612 B2
(45) Date of Patent: Apr. 3, 2012

(54) TRAFFIC INFORMATION DISTRIBUTING APPARATUS

(75) Inventors: Kenji Nagase, Okazaki (JP); Hiroki Ishikawa, Okazaki (JP); Takayasu Nakada, Okazaki (JP)

(73) Assignee: Aisin Aw Co., Ltd. (JP)

( * ) Notice: Subject to any disclaimer, the term of this patent is extended or adjusted under 35 U.S.C. 154(b) by 281 days.

(21) Appl. No.: 12/441,502

(22) PCT Filed: Sep. 27, 2007

(86) PCT No.: PCT/JP2007/069420

§ 371 (c)(1),
(2), (4) Date: Mar. 16, 2009

(87) PCT Pub. No.: WO2008/047606

PCT Pub. Date: Apr. 24, 2008

(65) Prior Publication Data

US 2010/0241344 A1 Sep. 23, 2010

(30) Foreign Application Priority Data

Oct. 13, 2006 (JP) ..... 2006-279827

(51) Int. Cl.
*G08G 1/123* (2006.01)
*G08G 1/133* (2006.01)

(52) U.S. Cl. ..... 701/118

(58) Field of Classification Search ..... 701/118, 701/201, 202, 204, 209, 210; 340/994, 995.23
See application file for complete search history.

(56) References Cited

U.S. PATENT DOCUMENTS

| | | | | |
|---|---|---|---|---|
| 6,292,742 | B1 | 9/2001 | Heimann et al. | 701/117 |
| 2005/0222750 | A1 * | 10/2005 | Tsuge et al. | 701/117 |
| 2008/0071466 | A1 * | 3/2008 | Downs et al. | 701/117 |

FOREIGN PATENT DOCUMENTS

| | | | |
|---|---|---|---|
| DE | 19629233 | | 1/1998 |
| DE | 19651143 | | 6/1998 |
| DE | 198 43 203 | A1 | 3/2000 |
| JP | 05-080696 | A | 4/1993 |
| JP | 2002-286469 | | 10/2002 |
| JP | 2003-122656 | A | 4/2003 |

* cited by examiner

*Primary Examiner* — Mark Beauchaine
(74) *Attorney, Agent, or Firm* — Bacon and Thomas, PLLC

(57) ABSTRACT

In a case where a CPU provided in an information distribution center has received, from a navigation apparatus, vehicle information together with a request command for requesting traffic information such as current traffic information, the CPU sets a road category that serves as a distribution target of the traffic information, based on one of a distance and a required travel time from a vehicle position to a destination. The CPU then extracts the traffic information that corresponds to the set road category and distributes it to the navigation apparatus.

8 Claims, 15 Drawing Sheets

TRAFFIC INFORMATION DISTRIBUTING APPARATUS

CROSS REFERENCE TO RELATED APPLICATION

This application is a U.S. National Phase, under 35 U.S.C. 371 of PCT Application No. PCT/JP2007/069420, filed Sep. 27, 2007, and claims priority of Japanese Application No. 2006-279827, filed Oct. 13, 2006.

TECHNICAL FIELD

The present invention relates to a traffic information distributing apparatus that distributes traffic information according to a transmission request received from a navigation apparatus installed in a vehicle.

BACKGROUND ART

In recent years, various types of traffic information distributing apparatuses that distribute traffic information according to a transmission request received from a navigation apparatus installed in a vehicle have been proposed.

One example is a traffic information distributing apparatus that receives a transmission request from a navigation apparatus installed in a vehicle by using a communicating unit, extracts, according to the received transmission request, traffic information that corresponds to roads within a predetermined range that includes a current position of the vehicle by using a traffic information extracting unit provided in an information distribution center, and distributes the extracted traffic information to the navigation apparatus by using a communicating unit (see, for example, Japanese Unexamined Patent Application Publication No. JP-A-2002-286469, paragraphs 0012 to 0063 and FIGS. 1-10).

DISCLOSURE OF THE INVENTION

The configuration disclosed in Japanese Unexamined Patent Application Publication No. JP-A-2002-286469 (paragraphs 0012 to 0063 and FIGS. 1-10), however, has a problem where unnecessary information is distributed because the following factors are not at all taken into consideration: the current position of the vehicle; a road category of the road on which the vehicle is positioned; the topography; the time period of the day; and the information amount of traffic information. For example, although the traffic conditions and the amounts of information are very different between daytime and nighttime, traffic information that corresponds to mutually the same range is distributed for both the daytime and the nighttime. Thus, a problem arises where the amount of information is increased because of a lot of unnecessary information contained therein, and thereby the communication cost becomes higher. Also, in a case where the distribution range is made smaller in order to reduce the amount of information, another problem arises where it is difficult to distribute a sufficient amount of traffic information.

In order to solve the problems described above, it is an object of the present invention to provide a traffic information distributing apparatus that makes it possible to keep the communication cost at a low level, while ensuring that a sufficient amount of traffic information is distributed.

In order to achieve the object of the present invention described above, the traffic information distributing apparatus of the present invention is a traffic information distributing apparatus that distributes traffic information and includes: a vehicle information receiving unit that receives vehicle information from a navigation apparatus installed in a vehicle; a road category setting unit that sets a road category that serves a distribution target of the traffic information, based on the vehicle information; a traffic information extracting unit that extracts the traffic information that corresponds to the road category; and a traffic information distribution controlling unit that controls so as to distribute the extracted traffic information to the navigation apparatus.

Preferably, the vehicle information includes vehicle position information that indicates a current position of the vehicle and destination information that indicates a destination, and the road category setting unit calculates one of a distance and a required travel time from the vehicle position to the destination, based on the vehicle position information and the destination information, and sets the road category that serves as the distribution target of the traffic information, based on the one of the distance and the required travel time that has been calculated.

The vehicle information includes vehicle position information that indicates a current position of the vehicle, and the road category setting unit sets a category of a road on which the vehicle is positioned as the road category that serves as the distribution target, based on the vehicle position information.

The vehicle information preferably includes destination information that indicates destination, the traffic information distributing apparatus preferably includes a route searching unit that searches for a route, based on the vehicle position information and the destination information, and in a case where the vehicle is positioned on one of an expressway and a toll road, the traffic information extracting unit further extracts traffic information that corresponds to a surrounding area of an exit of the one of the expressway and the toll road that is located on the route.

The traffic information distributing apparatus preferably includes: a vehicle information receiving unit that receives vehicle information from a navigation apparatus installed in a vehicle; a time detecting unit that detects a current time: a distribution range setting unit that sets a distribution range that serves as a distribution target of the traffic information, based on the vehicle information, based on the vehicle information and the current time; a traffic information extracting unit that extracts the traffic information that corresponds to the distribution range; and a traffic information distribution controlling unit that communicates the extracted traffic information to the navigation apparatus.

The traffic information distributing apparatus preferably includes: a vehicle information receiving unit that receives vehicle information from a navigation apparatus installed in a vehicle; a basic distribution range setting unit that sets a basic distribution range that serves as a distribution target of the traffic information, based on the vehicle information; a distribution range changing unit that sets a changed distribution range by changing the basic distribution range, based on a situation of a road within the basic distribution range; a traffic information extracting unit that extracts the traffic information that corresponds to the changed distribution range; and a traffic information distribution controlling unit that controls so as to distribute the extracted traffic information to the navigation apparatus.

The traffic information distributing apparatus may include a congested link calculating unit that calculates a proportion of congested links to all links within the basic distribution range, based on traffic information that corresponds to the basic distribution range. Whereby, in the traffic information distributing apparatus, the distribution range changing unit sets a changed distribution range, based on the proportion of the congested links to all the links.

The distribution range changing unit may include a distribution range judging unit that judges whether or not the basic distribution range includes any distribution range that contains no links, and in a case where the distribution range judging unit has judged that the basic distribution range includes one or more distribution ranges that contain no links, whereby the distribution range changing unit sets the changed distribution range so that the one or more distribution ranges that contain no links are excluded from the changed distribution range.

The traffic information distributing apparatus may include a route search unit that searches for a route, based on the vehicle position information and the destination information, whereby the basic distribution range setting unit sets the basic distribution range in a forward direction, in terms of a traveling direction of the vehicle, of the current position of the vehicle, and in a case where a surrounding area of the current position of the vehicle contains as many drivable links as, or more drivable links than, a predetermined number, the distribution range changing unit sets the changed distribution range so that the surrounding area of the current position of the vehicle is included in the changed distribution range.

The distribution range changing unit may include a traffic obstruction judging unit that judges whether or not there is any traffic obstruction within the basic distribution range, and in case where the traffic obstruction judging unit has judged that there is a traffic obstruction within the basic distribution range, the distribution range changing unit sets the changed distribution range by enlarging the basic distribution range.

The traffic information distributing apparatus may further include: a search criterion receiving unit that receives a search criterion used for searching for a route, from a navigation apparatus installed in a vehicle; a distribution range setting unit that sets a distribution range that serves as a distribution target of the traffic information, based on the search criterion; a traffic information extracting unit that extracts the traffic information that corresponds to the distribution range; and a traffic information distribution controlling unit that controls so as to distribute the extracted traffic information to the navigation apparatus.

When the traffic information distributing apparatus configured as described above is used, the road category that serves as the distribution target of the traffic information is set based on the vehicle information received from the navigation apparatus installed in the vehicle. Then, the traffic information that corresponds to the road category that has been set is extracted and distributed to the navigation apparatus.

With this arrangement, the road category (e.g., "expressways/toll roads", "prefectural roads and larger roads", or "all the roads") is set based on the vehicle information received from the navigation apparatus. Thus, it is possible to set the road category appropriately in correspondence with the situation of the vehicle, to eliminate the traffic information that corresponds to the unnecessary road categories, and to keep the communication cost at a low level, while ensuring that a sufficient amount of traffic information is distributed to the navigation apparatus.

When one of the distance and the required travel time from the vehicle position to the destination is calculated, based on the vehicle position information and the destination information that are included in the vehicle information received from the navigation apparatus. ???????, the road category that serves as an extraction target of the traffic information is set. Then, the traffic information that corresponds to the road category that has been set is distributed to the navigation apparatus.

With this arrangement, the road category that serves as the extraction target of the traffic information is set based on the one of the distance and the required travel time from the current position of the vehicle to the destination, so that the traffic information that corresponds to the road category that has been set is distributed. Thus, even if the distance (e.g., a short distance, a medium long distance, or a long distance) or the required travel time (e.g., a short time, a medium long time, and a long time) from the current position of the vehicle to the destination varies, it is possible to set the information amount of the traffic information to be distributed at an appropriate level. Consequently, it is possible to keep the communication cost at a low level, while ensuring that a sufficient amount of traffic information is distributed to the navigation apparatus.

vehicle position information that indicates the current position of the vehicle (hereinafter, simply referred to as "the position of the vehicle" or "the vehicle position") and is included in the vehicle information received from the navigation apparatus, the category (e.g., "expressways/toll roads, "general roads", or "small streets") of the road on which the vehicle is positioned is set as the road category that serves as the distribution target.

With this arrangement, the traffic information that corresponds to the category of the road on which the vehicle is positioned is extracted and distributed to the navigation apparatus. Thus, it is possible to eliminate the traffic information that corresponds to the road categories on which the vehicle is not driven and thereby to keep the communication cost at a low level, while ensuring that a sufficient amount of traffic information is distributed.

When a route is searched form, based on the vehicle position information and the destination information that are included in the vehicle information received from the navigation apparatus, in a case where the vehicle is positioned on one of an expressway and a toll road, the traffic information that corresponds to the surrounding area of the exit of the one of the expressway and the toll road that is located on the route is further extracted and distributed to the navigation apparatus.

With this arrangement, the traffic information that corresponds to the route on the one of the expressway and the toll road on which the vehicle is driven as well as the surrounding area of the exit of the one of the expressway and the toll road is distributed to the navigation apparatus. Thus, it is possible to eliminate, by a large amount, unnecessary traffic information and to keep the communication cost at an even lower level, while ensuring that a sufficient amount of traffic information is distributed.

When a the distribution range that serves as the distribution target of the traffic information is set, based on the vehicle information and the current time that have been received from the navigation apparatus installed in the vehicle, traffic information that corresponds to the distribution range that has been set may be extracted and distributed to the navigation apparatus.

With this arrangement, it is possible to set the distribution range that serves as the distribution target of the traffic information, while taking the situation of the vehicle such as the current position of the vehicle and time-related factors such as the time period of the day into consideration. Thus, it is possible to set the distribution range for any one of the time periods during which the roads are likely to be congested so that the information amount of the traffic information is at an appropriate level. Consequently, it is possible to keep the communication cost at a low level, while ensuring that a sufficient amount of traffic information is distributed.

When the basis distribution range that serves as the distribution target of the traffic information is set, based on the vehicle information received from the navigation apparatus installed in the vehicle, the changed distribution range may be set by changing the basic distribution range, based on the situation of the roads within the basic distribution range. After that, the traffic information that corresponds to the changed distribution range that has been set is extracted and distributed to the navigation apparatus.

With this arrangement, it is possible to set the changed distribution range that serves as the distribution target of the traffic information, while taking the situation of the roads within the basic distribution range into consideration. Thus, it is possible to eliminate any unnecessary distribution ranges within the basic distribution range and to keep the communication cost at a low level, while ensuring that a sufficient amount of traffic information is distributed by changing the basic distribution range.

When a changed distribution range is set, based on the proportion of the congested links to all the links within the basic distribution range, in a case where the proportion of the congested links exceeds the predetermined value, it is possible to set the changed distribution range by reducing the basic distribution range, whereas in a case where the proportion of the congested links is equal to or lower than the predetermined value, it is possible to set the changed distribution range by enlarging the basic distribution range. Thus, it is possible to set the changed distribution range so that the information amount of the traffic information to be distributed is at an appropriate level. Consequently, it is possible to keep the communication cost at an even lower level, while ensuring that a sufficient amount of traffic information is distributed.

In a case where it has been judged that the basic distribution range includes one or more distribution ranges that contain no links, the changed distribution range is set so that the one or more distribution ranges that contain no links are excluded from the changed distribution range.

With this arrangement, it is possible to set the changed distribution range so that distribution ranges that contain no links such as mountainous areas, sea coasts, and lake shores are excluded, while taking the current position of the vehicle and the driving route into consideration. Thus, it is possible to eliminate the traffic information that corresponds to the unnecessary distribution ranges and to keep the communication cost at a low level, while ensuring that a sufficient amount of traffic information is distributed in correspondence with the more effective distribution ranges.

When a route is searched form, based on the vehicle position information and the destination information that are included in the vehicle information received from the navigation apparatus, the basic distribution range may be set in the forward direction, in terms of the traveling direction of the vehicle, of the current position of the vehicle. Also, in a case where the surrounding area of the current position of the vehicle contains as many drivable links as, or more drivable links than, the predetermined number, the changed distribution range is set by changing the basic distribution range so that the surrounding area of the current position of the vehicle is included in the changed distribution range. Accordingly, the traffic information that corresponds to the changed distribution range is distributed to the navigation apparatus. With this arrangement, because the changed distribution range contains as many drivable links as, or more drivable links than, the predetermined number that are located in the surrounding area of the current position of the vehicle, it is possible to extract and distribute a sufficient amount of traffic information that is necessary for conducting the route search.

When there is a traffic obstruction within the basic distribution range, the changed distribution range is set by enlarging the basic distribution range so that the traffic information that corresponds to the changed distribution range is distributed to the navigation apparatus. With is arrangement, in the case where there is a traffic obstruction with the basic distribution range, it is possible to distribute the traffic information that corresponds to the changed distribution range that is wider than the basic distribution range. Thus, it is possible to distribute a sufficient amount of traffic information to the navigation apparatus. Consequently, with a high level of precision, the navigation apparatus is able to search for a detour route that goes around, by a large distance, the traffic obstruction such as an accident or traffic control.

Further, when the distribution range that serves as the distribution target of the traffic information is set, based on the search criterion of the route that is received from the navigation apparatus installed in the vehicle, the traffic information that corresponds to the distribution range that has been set is extracted and distributed to the navigation apparatus.

With this arrangement, because the changed distribution range is set based on the search criterion of the route, it is possible to set the changed distribution range by enlarging the basic distribution range in an outward direction, while taking a possible extension of the route found in the search into consideration. Thus, it is possible to distribute a sufficient amount of traffic information. Also, in the case where the route does not extend very much according to the search criterion, it is possible to set the changed distribution range by reducing the basic distribution range along the route. Thus, it is possible to reduce the information amount of the traffic information that corresponds to the changed distribution range. Consequently, it is possible to keep the communication cost at an even lower level Consequently, with a high level of precision, the navigation apparatus is able to search for a detour route that goes around, by a large distance, the traffic obstruction such as an accident or traffic control.

Further, when the distribution range that serves as the distribution target of the traffic information is set, based on the search criterion of the route that is received from the navigation apparatus installed in the vehicle, the traffic information that corresponds to the distribution range that has been set is extracted and distributed to the navigation apparatus.

With this arrangement, because the changed distribution range is set based on the search criterion of the route, it is possible to set the changed distribution range by enlarging the basic distribution range in an outward direction, while taking a possible extension of the route found in the search into consideration. Thus, it is possible to distribute a sufficient amount of traffic information. Also, in the case where the route does not extend very much according to the search criterion, it is possible to set the changed distribution range by reducing the basic distribution range along the route. Thus, it is possible to reduce the information amount of the traffic information that corresponds to the changed distribution range. Consequently, it is possible to keep the communication cost at an even lower level.

BEST MODES FOR CARRYING OUT THE INVENTION

A traffic information distributing apparatus according to the present invention will be explained in detail with reference to the accompanying drawings, through an exemplary embodiment in which the traffic information distributing apparatus is materialized in a navigation system.

Figure 1:
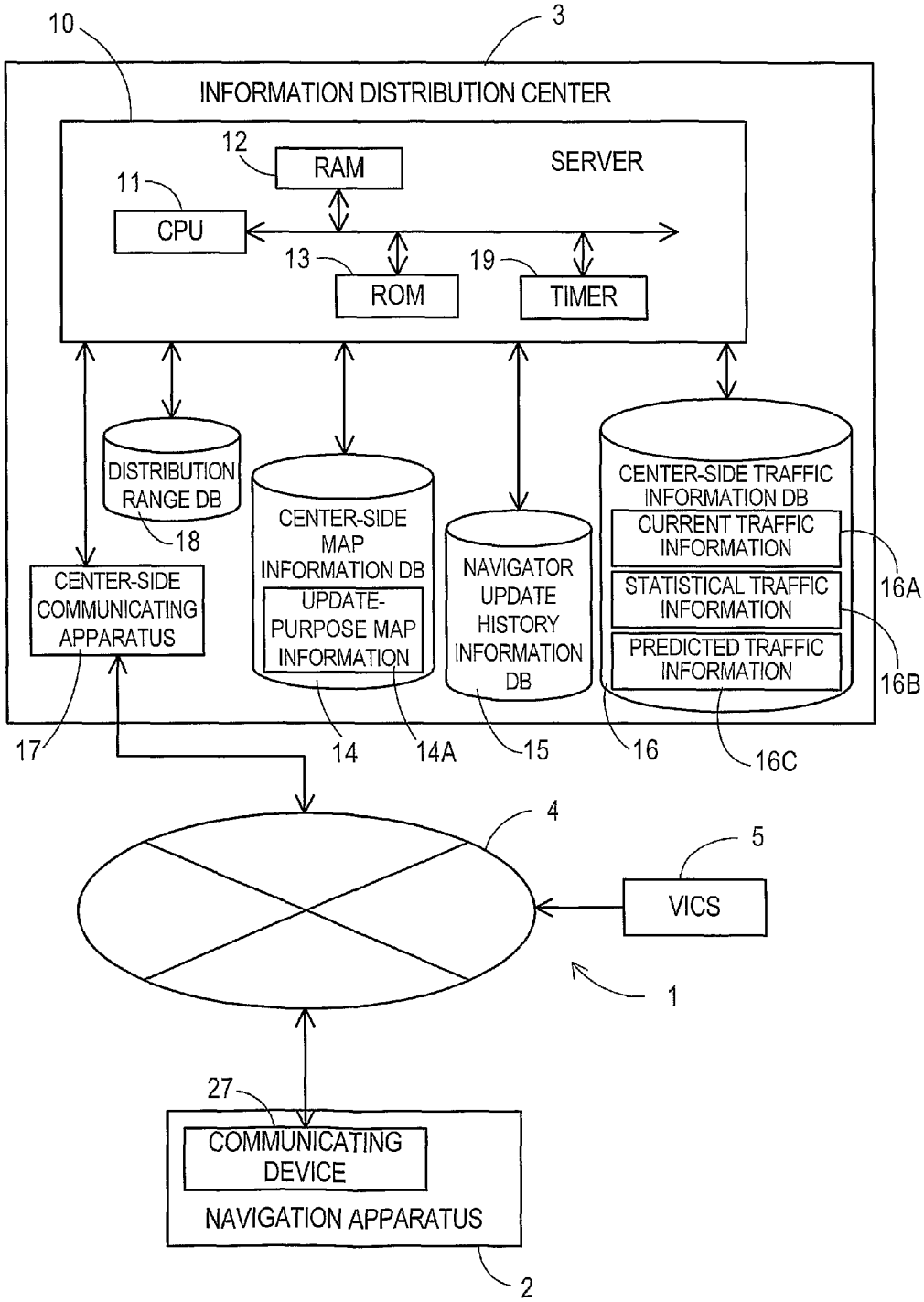
FIG. 1 is a block diagram that shows a navigation system according to an embodiment of the present invention.

A schematic configuration of a navigation system 1 according to the present embodiment will be explained with reference to FIG. 1. FIG. 1 is a block diagram that shows the navigation system 1 according to the present embodiment.

As shown in FIG. 1, the navigation system 1 according to the present embodiment is basically configured so as to include: a navigation apparatus 2; an information distribution center 3 that distributes, to the navigation apparatus 2, update information used for updating map information as well as traffic information including congestion information (which will be explained later); and a network 4. The navigation apparatus 2 and the information distribution center 3 are configured so as to be able to transmit and receive various types of information to and from each other, via the network 4.

A Vehicle Information and Communication System (VICS: a registered trademark) 5 is connected to the network 4. The navigation apparatus 2 and the information distribution center 3 are configured so as to be able to receive, once in a predetermined period of time via the network 4, traffic information including information related to congestion of roads and traffic control information that have been generated by collecting information from traffic control systems such as the police and the Japan Highway Public Corporation. The traffic information is detailed information related to road traffic information such as, for example, road congestion information related to congestion of roads and traffic control information due to road constructions and building constructions.

The detailed information, if it is road congestion information, shows the following: a VICS link ID (explained later); the actual length of the congestion, the time required to drive through the congestion; the level of congestion (e.g., no congestion/crowded/congested); the speed of the vehicles in the congestion; the travel time; the traveling direction in the congested lane; and the time at which the congestion is expected to be over. The detailed information, if it is traffic control information, shows the following: a VICS link ID (explained later); the duration period of a road construction or a building construction; the type of traffic control indicating that, for example, the road is closed, one lane is alternately shared between two-way traffic, or the number of lanes is reduced; and the time period during which the traffic control is applied. The configuration of the navigation apparatus 2 will be explained in detail later, with reference to FIG. 2.

As shown in FIG. 1, the information distribution center 3 includes: a server 10; a center-side map information database (hereinafter, "the center-side map information DB") 14 that is connected to the server 10 and serves as a map information recording unit; a navigator update history information database (hereinafter, "the navigator update history information DB") 15; a center-side traffic information database (hereinafter, "the center-side traffic information DB") 16; a center-side communicating apparatus 17; and a distribution range database (hereinafter "the distribution range DB") 18.

The server 10 includes: a CPU 11 that serves as a computing and controlling device that exercises the overall control of the server 10; internal storage devices such as a RAM 12 that is used as a working memory when the CPU 11 performs various types of computation processes and a ROM 13; and a timer 19 that measures time. It is acceptable to use an MPU instead of the CPU 11. The ROM 13 has recorded therein various types of control programs for performing a map information updating process to, according to a request from the navigation apparatus 2, extract update information from the center-side map information DB 14 and distribute the extracted update information to the navigation apparatus 2, so as to update a piece of map information corresponding to a predetermined area out of pieces of map information stored in the navigation apparatus 2, with a piece of map information of a new version.

The ROM 13 also stores therein a control program for performing a traffic information distributing process (see FIG. 3) to generate current traffic information based on probe information collected from probe cars and traffic information collected from the Vehicle Information Communication System (VICE: a registered trademark) 5 and to distribute, according to a request from the navigation apparatus 2, the current traffic information via the network 4. Examples of the probe information include: the month, the day and the time, link information (e.g., a mesh ID, a link ID, the link length, whether there are traffic lights or not, the type of the road etc.), the traffic conditions (e.g., the travel time, the level of congestion, the speed etc.), the position of the vehicle, a mesh ID of the secondary mesh to which the vehicle position belongs, the operating state of the windshield wipers, the vehicle exterior/road surface temperature, the weather, ABS (Antilock Brake System) operation information, the road surface conditions, and the vehicle information (e.g., the type of the vehicle, the specifications and performance, the vehicle speed, the passengers, the allocation rate of the weight of the vehicle, and how a torque is applied).

The center-side map information DB 14 stores therein update-purpose map information 14A that is map information used as a base when the map information that has been generated in the information distribution center 3 and stored in the navigation apparatus 2 is to be updated, the update-purpose map information 14A being stored while being separated according to the version thereof. The center-side map information DB 14 further stores therein update information used for updating a part or the entirety of the map information currently stored in the navigation apparatus 2 with the update-purpose map information 14A. The version mentioned here is generation time information for identifying a time at which each piece of map information was generated. By referring to the version, it is possible to identify a time at which each piece of map information was generated.

Various types of information that are required in order for the navigation apparatus 2 to provide route guidance and display maps are recorded in the update-purpose map information 14A stored in the center-side map information DB 14. For example, the update-purpose map information 14A includes map display data used for displaying maps, intersection data related to intersections, node data related to node points, link data related to roads (i.e., road links) that are a type of facility, search data for searching for a route, shop data related to Points of Interest (POI) such as shops that are a type of facility, and retrieval data for retrieving a point of location.

In particular, the map display data is structured with units of quarters (dividing the length into halves), units of sixteenths (dividing the length into quarters), and units of sixty-fourths (dividing the length into eighths) obtained by dividing the secondary meshes each of which is approximately 10 kilometers squared. The units for different locations are set so that the data amount for each of the unit is substantially at the same level. The smallest unit, which has the size of one sixty-fourth of a secondary mesh, is an area of approximately 1.25 kilometers squared.

As the node data, data related to the following is recorded: the actual branching points of the roads (including intersections and T-intersections); the coordinates (i.e., the positions) of the node points that are set in each of the roads for every section having a predetermined distance according to the curvature radius thereof or the like; the node attribute that shows whether each node corresponds to an intersection or not; a connected link number list that is a list of link IDs used as identification numbers of the links that are connected to the nodes; an adjacent node number list that is a list of the node numbers of the nodes that are positioned adjacent to the nodes via links; and the height (i.e., the altitude) of the node points.

As the link data, data related to the following is recorded: With regard to road links, (hereinafter, simply referred to as "links") that constitute roads, data expressing the width of the road to which the link belongs, the inclination, the cant, the bank, the road surface conditions, the number of lanes of the road, the locations at which the number of lanes is reduced, the locations at which the width of the road becomes smaller, and railroad crossings; With regard to corners, data expressing the curvature radius, the intersections, the T-intersections, the entrance and the exit of the corners; With regard to the road attribute, data expressing downhill roads and uphill roads; With regard to the types of the roads, data expressing general roads such as national roads, prefectural roads, and small streets as well as toll roads such as national expressways, urban expressways, ordinary toll roads, and toll bridges. In addition, with regard to the toll roads, data related to ramps at the entrance and the exit of each toll road and toll booths (i.e., interchanges) is recorded.

In the following description, national expressways, urban expressways, automobile-only roads, ordinary toll roads, and national routes identified with one-digit and two-digit numbers will be referred to as high-standard roads. National routes identified with three-digit numbers, major local roads, prefectural roads, roads belonging to cities, towns, or villages will be referred to as general roads. Also, streets that are narrower than the general roads and are seen in, for example, urban areas will be referred to as small streets.

As the search data, data that is used when a route to a specified destination is searched for or displayed is recorded. The search data includes cost data that is used for calculating a weight (hereinafter, referred to as a "cost") for each of the nodes that is determined based on a right/left turn made when the vehicle passes the node, the distance of the links that constitute the road, the width of the road, and the type of the road, as well as route display data used for displaying a route selected in a route searching process on a map displayed on a liquid crystal display 25 (see FIG. 2) included in the navigation apparatus 2.

As the shop data, data related to the POIs in each location such as hotels, hospitals, gas stations, parking lots, and sightseeing facilities is recorded with the IDs that identify the POIs, respectively. The center-side map information DB 14 also records therein audio output data for outputting predetermined information through a speaker 26 (see FIG. 2) that is included in the navigation apparatus 2.

At a time when a request is made by the navigation apparatus 2, the information distribution center 3 updates the map information stored in the navigation apparatus 2 with one of the pieces, which is the newest version, of update-purpose map information 14A stored in the center-side map information DB 14. More specifically, in the navigation system 1 according to the present embodiment, when the navigation apparatus 2 has requested that a piece of update-purpose map information 14A should be distributed thereto, update information used for updating the stored map information with the one of the pieces of update-purpose map information 14A, which is the newest version, is distributed to the navigation apparatus 2, so that an updating process can be performed.

In order to transmit the update information to the navigation apparatus 2, it is acceptable to transmit the entire information of the one of the pieces of update-purpose map information 14A, which is the newest version, that includes new road information for identifying newly-built roads. Alternatively, it is acceptable to transmit minimum necessary information (e.g., only the information in an updated portion that includes the new road information for identifying the newly-built roads) for updating the map information currently stored in the navigation apparatus 2 with the one of the pieces of update-purpose map information 14A, which is the newest version.

The navigator update history information DB 15 stores therein information related to an update history indicating the updates that have so far been applied to the map information stored in the navigation apparatus 2, together with a navigator identifying ID that identifies the navigation apparatus 2. As the update history, data specifically showing which version of map information is used for each of the pieces of link data and the pieces of node data that constitute the map information is stored. Every time the map information stored in the navigation apparatus 2 is updated, the update history is re-written with new data.

The center-side traffic information DB 16 stores therein current traffic information 16A that is information related to current road congestion or the like and has been generated by collecting the probe information collected from the probe cars and traffic information received from the Vehicle Information Communication System (VICS: a registered trademark) 5. Examples of the probe information include: the month, the day and the time, link information (e.g., a mesh ID, a link ID, the link length, whether there are traffic lights or not, the type of the road etc.), the traffic conditions (e.g., the travel time, the level of congestion, the speed etc.), the position of the vehicle, a mesh ID of the secondary mesh to which the vehicle position belongs, the operating state of the windshield wipers, the vehicle exterior/road surface temperature, the weather, ABS (Antilock Brake System) operation information, the road surface conditions, and the vehicle information (e.g., the type of the vehicle, the specifications and performance, the vehicle speed, the passengers, the allocation rate of the weight of the vehicle, and how a torque is applied).

The center-side traffic information DB 16 also stores therein statistical traffic information 16B that has been generated based on traffic information from the past, including VICS signals received from the Vehicle Information. Communication System (VICS: a registered trademark) 5 and the probe information collected from the probe cars. The statistical traffic information 16B may include event schedule information such as locations, dates, and times of events including festivals, parades, and firework shows. The statistical traffic information 1613 may also include statistical congestion information or congestion prediction information indicating that, for example, the roads near a station or a large shopping mall are congested every day during a specific time period of the day except on the weekends, or the roads near a swimming beach are congested during summer holidays.

The center-side traffic information DB 16 also stores therein predicted traffic information 16C that is congestion prediction information or the like and is predicted for once in a predetermined period of time in the future (e.g., "once every 15 minutes", "once every 30 minutes", or "once every hour" after the current time) with respect to the current congestion situations generated based on the current traffic information 16A and the statistical traffic information 16B.

At a time when a request is made by the navigation apparatus 2, the information distribution center 3 selects and distributes traffic information between intersections based on the current traffic information 16A, the statistical traffic information 16B, and the predicted traffic information 16C that is congestion prediction information or the like, each of which is stored in the center-side traffic information DB 16.

The traffic information received from the Vehicle Information and Communication System (VICS: a registered trademark) 5 includes a VICS link ID as well as the road type information, and information related to the position, the distance of the congested section, and the level of congestion. The VICS link ID is an identification number that is assigned to each VICS link serving as a driving guidance link standardized while the road is divided into sections at predetermined intersections. The traffic information also includes information related to the coordinates of the starting point and the ending point of each of the VICS links and also a distance between the starting point and the ending point.

The roads (i.e., links) that are stored in the center-side map information DB 14 and the VICS links are not the same as each other (Generally speaking, roads (links) are more finely divided than VICS links are). Thus, a conversion table (i.e., a reference table) to convert between road link IDs and the VICS link IDs is provided, the road link IDs being assigned to the roads (i.e., links), respectively, as identification numbers. By referring to the conversion table, it is possible to identify, based on a VICS link ID, a road link ID that corresponds to the VICS link ID. With this arrangement, it is possible to transmit the traffic information after converting the VICS link IDs to road link IDs that are used in the navigation apparatus 2.

The distribution range DB 18 stores therein a basic distribution range 88 (see FIG. 8) and a basic distribution range 101 (see FIG. 11) that serve as basic predetermined ranges (e.g., each range has an area of 50 kilometers squared in which a vehicle position is located at the center thereof) that are used as transmission targets of the current traffic information 16A, the statistical traffic information 16B, and the predicted traffic information 16C, when any of these types of traffic information 16A, 16B, and 16C is distributed according to a request made by the navigation apparatus 2 (as explained later).

It is acceptable to have an arrangement in which the information distribution center 3 is run by any of the following: an individual, a corporation, an organization, a local government, and a government-related organization. The information distribution center 3 may be run by the Vehicle Information Communication System (VICS: a registered trademark) 5, as well.

As the network 4, it is possible to use a communication system of any communication network such as, for example, a LAN (Local Area Network), a WAN (Wide Area Network), an Intranet, a mobile phone line network, a telephone line network, a public communication line network, a dedicated communication line network, or the Internet. It is also possible to use a communication system that uses CS broadcast realized by broadcast satellites, BS broadcast, terrestrial digital television broadcast, or FM multiplex broadcast. Further, it is also possible to use a communication system in an Electronic Toll Collection (ETC) system used in Intelligent Transport Systems (ITS) or in a Dedicated Short Range Communication (DSRC) system.

Figure 2:
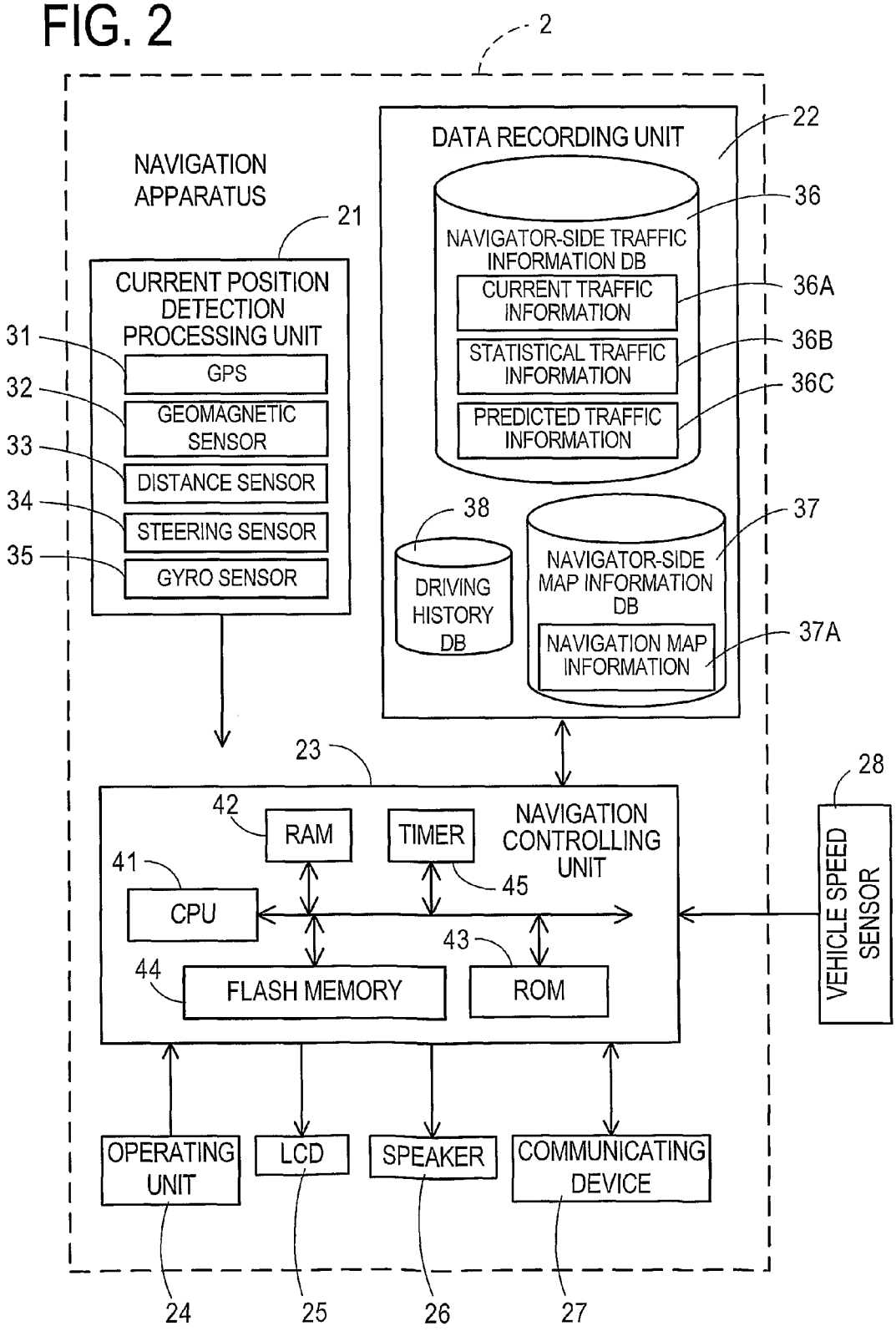
FIG. 2 is a block diagram that shows a navigation apparatus included in the navigation system.

Next, a schematic configuration of the navigation apparatus 2 that is included in the navigation system 1 according to the present embodiment will be explained, with reference to FIG. 2. FIG. 2 is a block diagram that shows the navigation apparatus 2 according to the present embodiment.

As shown in FIG. 2, the navigation apparatus 2 according to the present embodiment includes a current position detection processing unit 21 that detects a current position of the vehicle in which the navigation apparatus 2 is installed; a data recording unit 22 that has recorded therein various types of data; a navigation controlling unit 23 that performs various types of computation processes, based on input information; an operating unit 24 that receives an operation from an operator; the liquid crystal display 25 that displays information such as maps to the operator; the speaker 26 that outputs audio guidance related to route guidance; and a communicating device 27 that performs communication with the Vehicle Information and Communication System (VICS: a registered trademark) 5, the information distribution center 3, or the like via, for example, a mobile phone line network. A vehicle speed sensor 28 that detects the driving speed of the vehicle is connected to the navigation controlling unit 23.

Next, the constituent elements of the navigation apparatus 2 will be explained. The current position detection processing unit 21 includes a GPS 31, a geomagnetic sensor 32, a distance sensor 33, a steering sensor 34, a gyro sensor 35 that serves as a direction detecting unit, and an altimeter (not shown in the drawing). The current position detection processing unit 21 is configured so as to be able to detect a current position of the vehicle, the direction in which the vehicle is oriented, the distance to a target object (for example, an intersection), and the like.

More specifically, the UPS 31 detects a current position of the vehicle on the earth and a current time by receiving a radiowave generated by an artificial satellite. The geomagnetic sensor 32 detects the direction in which the vehicle is oriented by measuring the terrestrial magnetism. The distance sensor 33 detects, for example, a distance between predetermined positions on a road. As the distance sensor 33, it is acceptable to use a sensor that measures the rotation speed of the wheels (not shown in the drawing) of the vehicle and detects a distance based on the measured rotation speed, or a sensor that measures the acceleration and detects a distance by performing the integration twice on the measured acceleration.

The steering sensor 34 detects a steering angle of the vehicle. As the steering sensor 34, it is acceptable to use, for example, an optical rotation sensor that is attached to a rotating portion of the steering wheel (not shown in the drawing), a rotation resistance sensor, or an angle sensor attached to the wheels.

The gyro sensor 35 detects the turning angle of the vehicle. As the gyro sensor 35, it is acceptable to use, for example, a gas rate gyro, a vibration gyro, or the like. By performing the integration on the turning angle detected by the gyro sensor 35, it is possible to detect the direction in which the vehicle is oriented.

The data recording unit 22 includes: a hard disk (not shown in the drawing) that serves as an external storage device and a storage medium; databases that are stored in the hard disk, the databases namely being a navigator-side traffic information database (hereinafter, "the navigator-side traffic information DB") 36, a navigator-side map information database (hereinafter, "the navigator-side map information DB) 37, and a driving history database (hereinafter, "the driving history DB") 38; and a recording head (not shown in the drawing) that serves as a driver to read a predetermined program and the like and also to write predetermined data to the hard disk.

In the present embodiment, the hard disk is used as the external storage device and the storage medium included in the data recording unit 22; however, instead of the hard disk, it is acceptable to use a magnetic disc such as a flexible disc as the external storage device. Alternatively, it is acceptable to use, as the external storage device, a memory card, a magnetic tape, a magnetic drum, a CD, an MD, a DVD, an optical disc, an MO, an IC card, an optical card, or the like.

The navigator-side traffic information DB 36 stores therein current traffic information 36A generated based on traffic information that has been received from the information distribution center 3 or the Vehicle Information and Communication System (VICS) 5, the traffic information including road congestion information related to the current congestion conditions of the roads such as the actual length of the congestion, the required travel time, the cause of the congestion, and the time at which the congestion is expected to be over as well as traffic control information due to road constructions, building constructions, and the like. Statistical traffic information 36B stored in the navigator-side traffic information DB 36 includes the aforementioned statistical traffic information 16B that has been distributed from the information distribution center 3 via the communicating device 27.

The contents of the statistical traffic information 16B included in the statistical traffic information 36B is updated by downloading the update information that has been distributed from the information distribution center 3 via the communicating device 27. It is acceptable to configure the navigation apparatus 2 so as to have an arrangement in which the aforementioned statistical traffic information 16B supplied on a CD-ROM or the like is stored into the statistical traffic information 36B, so that the statistical traffic information 36B is updated based on a driving history, once in a predetermined period of time (for example, once a week or once every three months).

The statistical traffic information 36B may also include event schedule information such as locations, dates, and times of events including festivals, parades, and firework shows. In addition, the statistical traffic information 36B may also include statistical congestion information or congestion prediction information indicating that, for example, the roads near a station or a large shopping mall are congested every day during a specific time period of the day except on the weekends, or the roads near a swimming beach are congested during summer holidays.

Further, the navigator-side traffic information DB 36 stores therein the predicted traffic information 16C described above that has been distributed from the information distribution center 3 via the communicating device 27. The contents of the predicted traffic information 16C included in the predicted traffic information 36C is updated by downloading the update information that has been distributed from the information distribution center 3 via the communicating device 27. It is acceptable to configure the navigation apparatus 2 so as to have an arrangement in which the aforementioned predicted traffic information 16C supplied on a CD-ROM or the like is stored into the predicted traffic information 36C, so that the predicted traffic information 36C is updated based on the current traffic information 36A and the statistical traffic information 36B, once in a predetermined period of time (for example, once a week or once every three months).

The navigator-side map information DB 37 stores therein navigation map information 37A that is used in driving guidance and route searches performed by the navigation apparatus 2 and is also a target of an update performed by the information distribution center 3. Like the update-purpose map information 14A, the navigation map information 37A includes various types of information that are required in order to provide route guidance and display maps. The navigation map information 37A includes, for example, new road information for identifying newly-built roads, map display data for displaying maps, intersection data related to intersections, node data related to node points, link data related to roads (i.e., links) that are a type of facility, search data for searching for a route, shop data related to Points of Interest (POD such as shops that are a type of facility, and retrieval data for retrieving a point of location.

The details of the various types of data have already been explained above. Thus, detailed explanation thereof will be omitted. The contents of the navigator-side map information DB 37 is updated by downloading the update information that has been distributed from the information distribution center 3 via the communicating device 27.

Every time the vehicle is driven on a link, the driving history DB 38 sequentially stores therein, a driving history. Examples of the driving history include: the month, the day and the time, link information (e.g., a mesh ID, a link ID, the link length, whether there are traffic lights or not, the type of the road etc.), the traffic conditions (e.g., the travel time, the level of congestion, the speed etc.), the position of the vehicle, a mesh ID of the secondary mesh to which the vehicle position belongs, the operating state of the windshield wipers, the vehicle exterior/road surface temperature, the weather, ABS (Antilock Brake System) operation information, the road surface conditions, and the vehicle information (e.g., the type of the vehicle, the specifications and performance, the vehicle speed, the passengers, the allocation rate of the weight of the vehicle, and how a torque is applied).

Also, as shown in FIG. 2, the navigation controlling unit 23 included in the navigation apparatus 2 includes: a CPU 41 that serves as a computing and controlling device that exercises the overall control of the navigation apparatus 2; internal storage devices such as a RAM 42 that is used as a working memory when the CPU 41 performs various types of computation processes and that stores therein, for example, route data after a route has been found in a search and the traffic information received from the information distribution center 3, a ROM 43 that stores therein, in addition to programs used for exercising control, a traffic information obtaining process program (see FIG. 3) used for requesting the information distribution center 3 that traffic information should be distributed, and a flash memory 44 that stores therein a program that has been read from the ROM 43; as well as a timer 45 that measures time.

As each of the RAM 42, the ROM 43, and the flash memory 44, it is acceptable to use a semiconductor memory, a magnetic core, or the like. Also, as the computing and controlling device, it is acceptable to use an MPU or the like, instead of the CPU 41.

According to the present embodiment, various types of programs are stored in the ROM 43, and also various types of data are stored in the data recording unit 22; however, it is also acceptable to have an arrangement in which the programs and the data are read from the same external storage device such as a memory card and written to the flash memory 44. Further, by replacing the memory card or the like, it is possible to update the programs and the data.

Further, peripheral devices (actuators) for the operating unit 24, the liquid crystal display 25, the speaker 26, and the communicating device 27 are electrically connected to the navigation controlling unit 23.

The operating unit 24 is operated, for example, when a starting point that serves as a guidance starting location and a destination that serves as a guidance terminal location are input by correcting the current location indicated when the vehicle starts being driven or when information related to facilities is retrieved. The operating unit 24 includes various types of keys and a plurality of operation switches. According to each of switch signals that are output when the switches are pushed or the like, the navigation controlling unit 23 exercises control so that a corresponding one of various types of operations is performed.

As the operating unit 24, it is acceptable to use a keyboard, a mouse, a barcode reader, a remote control device for remote-control operations; a joy stick, a light pen, a stylus pen, or the like. Further, it is acceptable to configure the operating unit 24 with a touch panel provided on the front surface of the liquid crystal display 25.

The liquid crystal display 25 is operable to display a route guidance screen on which a map based on the navigation map information 37A is displayed so that traffic information for each of the links can be displayed. The liquid crystal display 25 is also operable to display an operation guide, guidance related to operation menus and keys, a guiding route to guide the vehicle from a current location to a destination, guidance information along the guiding route, the traffic information, news, weather forecasts, the time, electronic mail, TV programs, and the like. Instead of the liquid crystal display 25, it is acceptable to use a CRT display, a plasma display, or the like. It is also acceptable to use a hologram device that projects a hologram image onto the windshield glass of the vehicle.

According to an instruction from the navigation controlling unit 23, the speaker 26 outputs, for example, audio guidance to guide the vehicle to drive along the guiding route. The audio guidance that is provided as a guide may be, for example, "Go 200 meters and turn right at intersection X", "National Route No. X ahead is congested." The audio output from the speaker 26 may be a synthesized audio, various types of sound effects, or various types of other guidance information that has been recorded on a tape or in a memory, in advance.

The communicating device 27 is a communicating unit that performs communication with the information distribution center 3 via a mobile phone line network, or the like. The communicating device 27 also transmits and receives a piece of update map information, which is the newest version as well as the current traffic information to and from the information distribution center 3. In addition, the communicating device 27 receives, not only information from the information distribution center 3, but also traffic information transmitted from the Vehicle Information Communication System (VICS) 5 or the like that includes congestion information, traffic control information, parking lot information, traffic accident information, and information about how crowded service areas are.

Next, the traffic information obtaining process that is performed by the CPU 41 included in the navigation apparatus 2 and the traffic information distributing process that is performed by the CPU 11 provided in the information distribution center 3 to distribute the traffic information to the navigation apparatus 2, in the navigation system 1 configured as described above, will be explained with reference to FIGS. 3 to 16.

Figure 3:
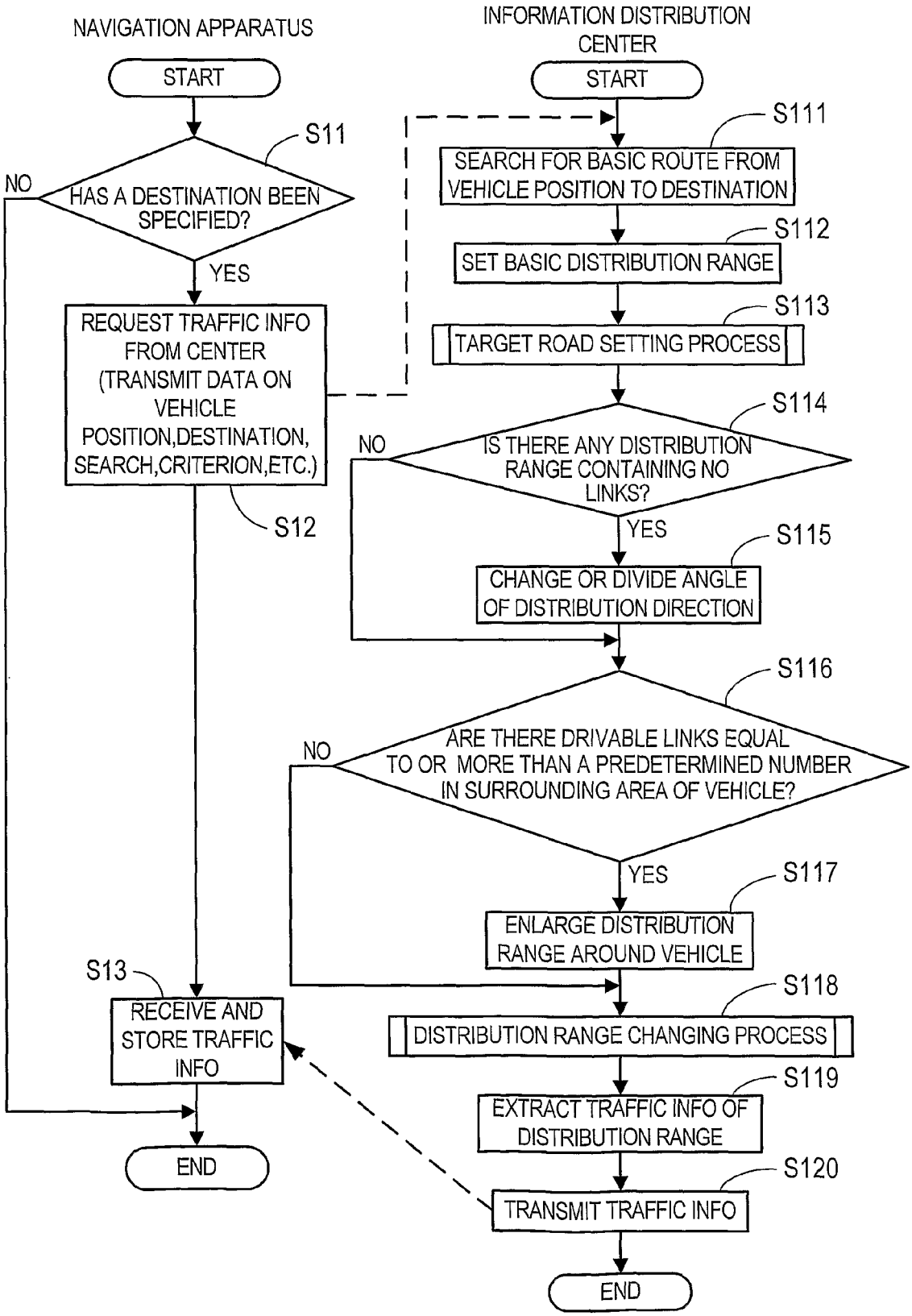
FIG. 3 is a main flowchart that shows a traffic information obtaining process that is performed by a CPU included in the navigation apparatus and a traffic information distributing process that is performed by a CPU provided in an information distribution center to distribute traffic information to the navigation apparatus.
Figure 4:
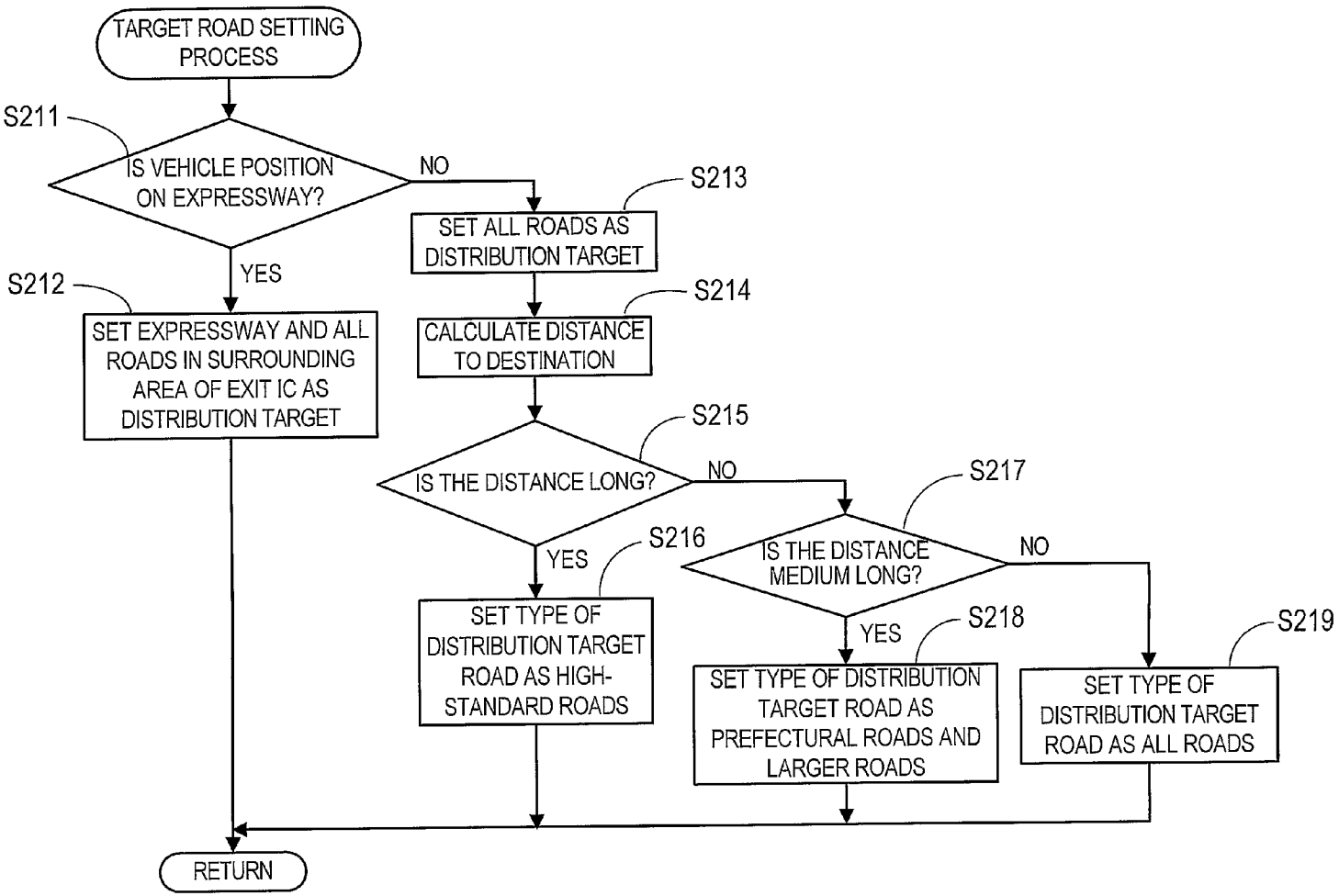
FIG. 4 is a sub-flowchart that shows a sub-process of a target road setting process shown in FIG. 3.
Figure 5:
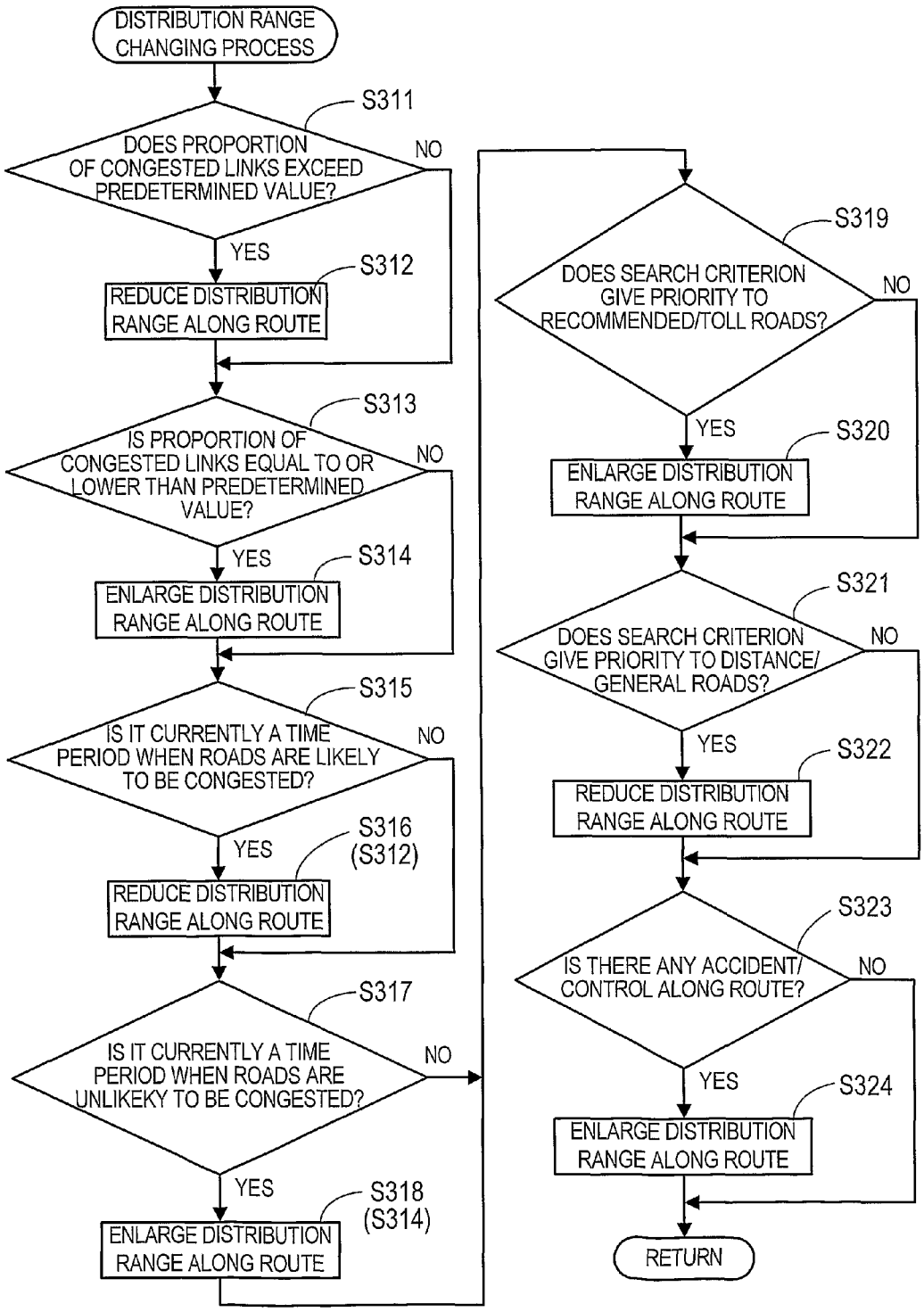
FIG. 5 is a sub-flowchart that shows a sub-process of a distribution range changing process shown in FIG. 3.

FIG. 3 is a main flowchart that shows the traffic information obtaining process that is performed by the CPU 41 included in the navigation apparatus 2 and the traffic information distributing process that is performed by the CPU 11 provided in the information distribution center 3 to distribute the traffic information to the navigation apparatus 2. FIG. 4 is a sub-flowchart that shows a sub-process of a target road setting process shown in FIG. 3. FIG. 5 is a sub-flowchart that shows a sub-process of a distribution range changing process shown in FIG. 3.

First, the "traffic information obtaining process" that is performed by the CPU 41 included in the navigation apparatus 2 will be explained, with reference to FIG. 3. The program shown at S11 through S13 in the flowchart in FIG. 3 is stored in the RAM 42 or the ROM 43 included in the navigation apparatus 2 and is executed by the CPU 41.

As shown in FIG. 3, at first, at step (hereinafter, simply expressed as "S") 11, the CPU 41 performs a judging process to judge whether or not a destination has been specified through an input operation performed on the operating unit 24 such as a touch panel or an operation switch. In a case where no destination has been specified (S11: NO), the CPU 41 ends the process. On the contrary, in a case where it is judged that a destination has been input (S11: YES), the CPU 41 temporarily stores coordinates of the destination or the like into the RAM 42 and then proceeds to the process at S12.

Subsequently, at S12, the CPU 41 transmits, to the information distribution center 3, a request command for requesting traffic information as well as a navigator identifying ID, coordinate data of a current position of the vehicle in which the CPU 41 is included (hereinafter, simply referred to as "the position of the vehicle" or "the vehicle position"), coordinate data of the destination, a route search criterion, the version information of the navigation map information 37A, and the like. After that, at S13, the CPU 41 receives, from the information distribution center 3, the current traffic information 16A and the like that includes the congestion information and the traffic control information and stores the received current traffic information 16A and the like into the current traffic information 36A and the like, before ending this process.

Next, the "traffic information distributing process" performed by the CPU 11 provided in the information distribution center 3 will be explained, with reference to FIG. 3. The program shown at S111 through S120 in the flowchart in FIG. 3 is stored in the RAM 12 or the ROM 13 included in the information distribution center 3 and is executed by the CPU 11.

First, at S111, the CPU 11 receives the request command for requesting the traffic information that has been transmitted from the navigation apparatus 2 at S12 as explained above, as well as the navigator identifying ID, the coordinate data of the position of the vehicle, the coordinate data of the destination, the route search criterion, the version information of the navigation map information 37A, and the like. The CPU 11 then stores the received information into the RAM 12. The CPU 11 searches for a basic route to get to the destination according to the received search criterion, based on the update-purpose map information 14A that corresponds to the version information of the navigation map information 37A stored in the center-side map information DB 14 and stores the basic route found in the search into the RAM 12.

At S112, the CPU 11 reads a basic distribution range that serves as a transmission target of the traffic information 16A, 16B, and 16C, out of the distribution range DB 18 and stores the read basic distribution range into the RAM 12. For example, in a case where the distance from the vehicle position to the destination is equal to or longer than 100 kilometers, a range having an area of 50 kilometers squared in which the vehicle position is located at the center thereof or a range having an area of 30 kilometers squared positioned in a forward direction of the vehicle position is read from the distribution range DB 18 and is stored into the RAM 12 as the basic distribution range.

Next, at S113, the CPU 11 performs a sub-process of the "target road setting process" to set a road category that serves as the distribution target of the traffic information.

In the following section, the sub-process of the "target road setting process" will be explained with reference to FIG. 4.

As shown in FIG. 4, at S211, based on the received vehicle position data, the CPU 11 judges whether or not the vehicle in which the navigation apparatus 2 is installed is positioned on one of what is called an expressway and a toll road such as a national expressway, an urban expressway, an automobile-only road, or a general toll road, by using the update-purpose map information 14A.

In a case it has been judged that the vehicle in which the navigation apparatus 2 is installed is positioned on one of what is called an expressway and a toll road (S211: YES), the CPU 11 proceeds to the process at S212. At S212, the CPU 11 sets, as the road category that serves as the distribution target of the traffic information, the one of the expressway and the toll road as well as all the roads that include small streets and any larger roads and that are located in a surrounding area of an exit of the one of the expressway and the toll road. The CPU 11 then stores the road category that has been set, into the RAM 12.

In addition, the CPU 11 sets, as a changed distribution range that is a distribution range serving as the distribution target of the traffic information in place of the basic distribution range that has been set at S112, the route on the one of the expressway and the toll road that is included in the basic route found in the search at S111 as well as the surrounding area of the exit of the one of the expressway and the toll road. The CPU 11 then stores the changed distribution range that has been set, into the RAM 12. Further, the CPU 11 reads a changed distribution range flag from the RAM 12 and assigns "1" to the read changed distribution range flag, before storing the changed distribution range flag back into the RAM 12. After that, the CPU 11 returns to the main flowchart. It should be noted that, when the CPU 11 is activated, "0" is assigned to the changed distribution range flag and stored in the RAM 12.

On the contrary, in a case where it has been judged that the vehicle in which the navigation apparatus 2 is installed is not positioned on one of what is called an expressway and a toll road (S211: NO), the CPU 11 proceeds to the process at S213. At S213, the CPU 11 sets, as the road category that serves as the distribution target of the traffic information, all the roads including small streets and any larger roads and stores the road category that has been set, into the RAM 12. After that, the CPU 11 proceeds to the process at S214.

Examples of distribution ranges each of which serves as the distribution target of the traffic information will be explained with reference to FIGS. 6A and 6B, in correspondence with the cases where the vehicle in which the navigation, apparatus 2 is installed is positioned (S211: YES) and is not positioned (S211: NO) on one of what is called an expressway and a toll road.

Figure 6A:
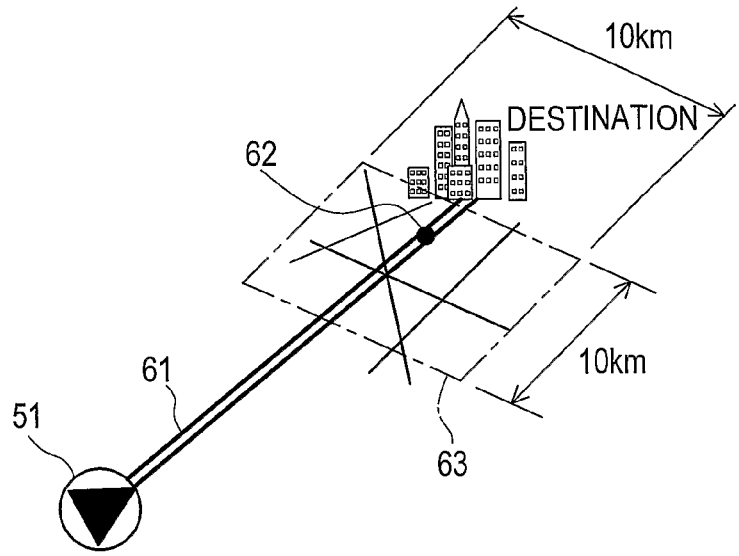
FIG. 6A is a drawing that shows an example of a distribution range that serves as a distribution target of traffic information in correspondence with a case where a vehicle in which the navigation apparatus is installed is positioned on one of what is called an expressway and a toll road.

FIG. 6A is a drawing that shows an example of the distribution range that serves as the distribution target of the traffic information in correspondence with the case where the vehicle in which the navigation apparatus 2 is installed is positioned on one of what is called an expressway and a toll road (S211: YES). FIG. 6B is a drawing that shows another example of the distribution range that serves as the distribution target of the traffic information in correspondence with the case where the vehicle in which the navigation apparatus 2 is installed is not positioned on one of what is called an expressway and a toll road (S211: NO).

As shown in FIG. 6A, in a case where a vehicle position mark 51 that indicates the vehicle in which the navigation apparatus 2 is installed is positioned on an expressway 61 (S211: YES), the CPU 11 sets, as the road category that serves as the distribution target of the traffic information, the expressway 61 on which the vehicle position mark 51 is positioned as well as all the roads that include the small streets and any larger roads and that are located in a surrounding area of an exit 62 of the expressway 61 that is located on the search route. The CPU 11 then stores the road category that has been set, into the RAM 12. In addition, the CPU 11 sets, as a changed distribution range that is a distribution range serving as the distribution target of the traffic information in place of the basic distribution range that has been set at S112, the route on the search route positioned on the expressway 61 in the forward direction of the vehicle position mark 51 as well as an area of 10 kilometers squared in which the exit 62 of the expressway 61 located on the search route is positioned at the center thereof. The CPU 11 then stores the changed distribution range that has been set, into the RAM 12.

Figure 6B:
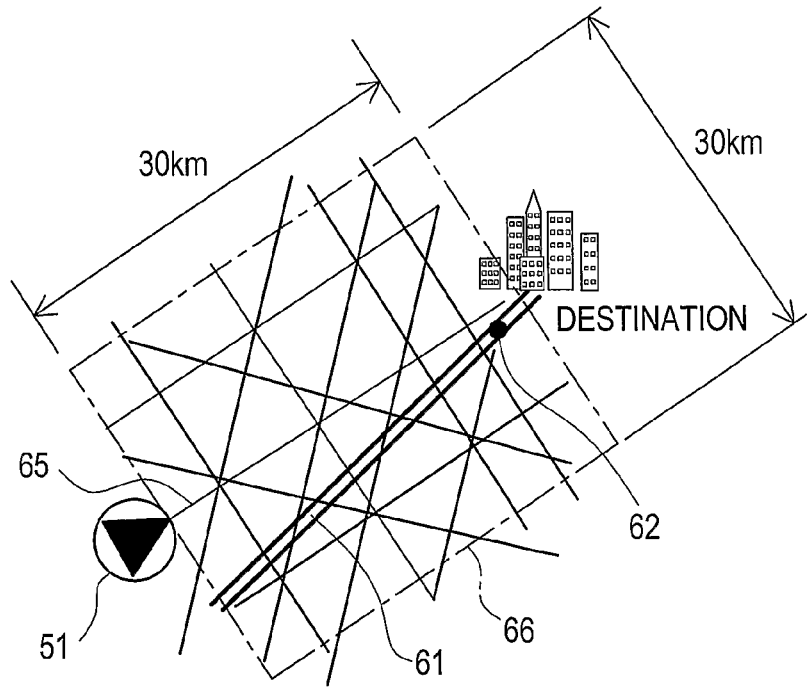
FIG. 6B is a drawing that shows another example of a distribution range that serves as the distribution target of the traffic information in correspondence with a case where a vehicle in which the navigation apparatus is installed is not positioned on one of what is called an expressway and a toll road.

As another example, as shown in FIG. 6B, in a case where the vehicle position mark 51 that indicates the vehicle in which the navigation apparatus 2 is installed is positioned on a general road 65 such as a national road or a prefectural road other than an expressway or a toll road (S211: NO), the CPU 11 sets, as the road category that serves as the distribution target of the traffic information, all the roads that include small streets and any larger roads and that are located within the basic distribution range 66 having an area of 30 kilometers squared and being located on the search route in a forward direction of the vehicle position mark 51. The CPU 11 then stores the road category that has been set, into the RAM 12.

Subsequently, as shown in FIG. 4, at S214, the CPU 11 calculates a distance from the vehicle position to the destination and a travel time required to drive the basic route, based on the data related to the vehicle position and the coordinate data of the destination that have been received. The CPU 11 then stores the distance and the required travel time that have been calculated into the RAM 12.

At S215, the CPU 11 performs a judging process to judge whether or not at least one of the distance and the required travel time from the vehicle position to the destination is long (e.g., equal to or longer than 100 kilometers/equal to or longer than 2 hours). In a case where at least one of the distance and the required travel time from the vehicle position to the destination is long (S215: YES), the CPU 11 proceeds to the process in S216. At S216, the CPU 11 sets, as the road category that serves as the distribution target of the traffic information, the high-standard roads including national expressways, urban expressways, automobile-only roads, ordinary toll roads, and national routes identified with one-digit and two-digit numbers. The CPU 11 then stores the road category that has been set into the RAM 12 and returns to the main flowchart.

On the contrary, in a case where the distance from the vehicle position to the destination is not long, and the required travel time is not long either (S215: NO), the CPU 11 proceeds to the process at S217. At S217, the CPU 11 performs a judging process to judge whether or not at least one of the distance and the required travel time from the vehicle position to the destination is medium long (e.g., equal to or longer than 30 kilometers and shorter than 100 kilometers/equal to or longer than 45 minutes and shorter than 2 hours).

In a case where at least one of the distance and the required travel time from the vehicle position to the destination is medium long (S217: YES), the CPU 11 proceeds to the process at S218. At S218, the CPU 11 sets, as the road category that serves as the distribution target of the traffic information, prefectural roads and larger roads. The CPU 11 then stores the road category that has been set into the RAM 12 and returns to the main flowchart.

On the contrary, in a case where the distance from the vehicle position to the destination is not medium long, and the required travel time is not medium long either, (S217: NO), the CPU 11 judges that at least one of the distance and the required travel time from the vehicle position to the destination is short (e.g., shorter than 30 kilometers/shorter than 45 minutes), and then proceeds to the process at S219. At S219, the CPU 11 again sets, as the road category that serves as the distribution target of the traffic information, all the roads including small streets and any larger roads. The CPU 11 then stores the road category that has been set into the RAM 12 and proceeds to the main flowchart.

Figure 7A:
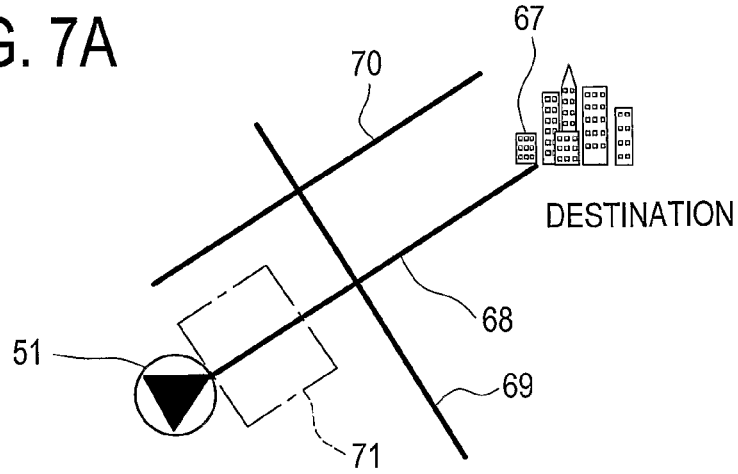
FIG. 7A is a drawing that shows an example in which a road category that serves as a distribution target of traffic information is set in correspondence with a case where at least one of the distance and the required travel time from the vehicle position to a destination is long.
Figure 7B:
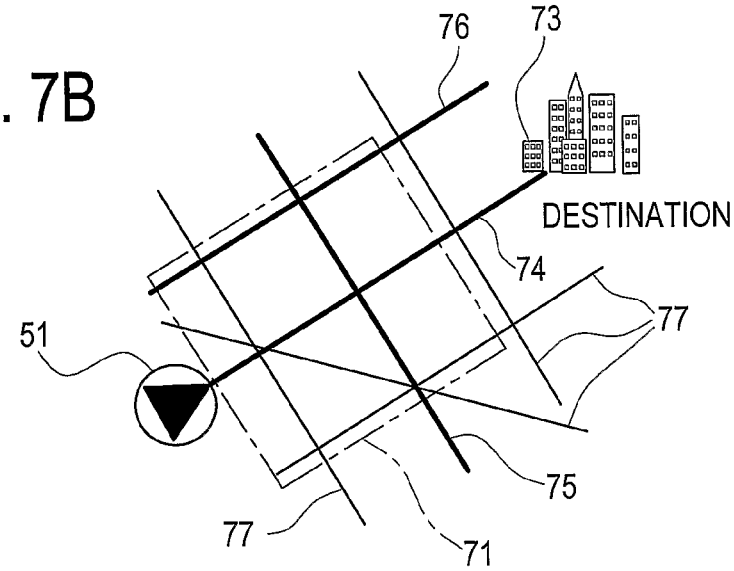
FIG. 7B is a drawing that shows an example in which the road category that serves as the distribution target of the traffic information is set in correspondence with a case where at least one of the distance and the required travel time from the vehicle position to a destination is medium long.
Figure 7C:
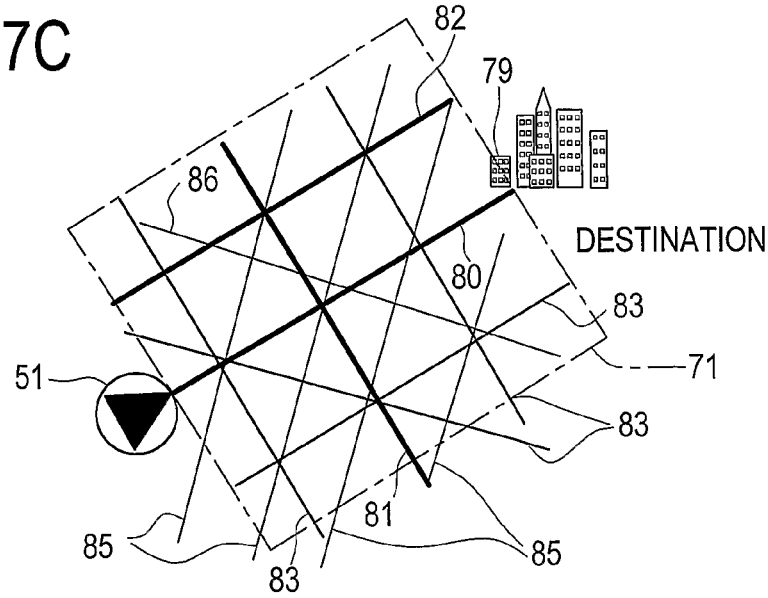
FIG. 7C is a drawing that shows an example in which the road category that serves as the distribution target of the traffic information is set in correspondence with a case where at least one of the distance and the required travel time from the vehicle position to a destination is short.

Next, examples in which the road category that serves as the distribution target of the traffic information is set according to one of the distance and the required travel time from the vehicle position to the destination will be explained with reference to FIGS. 7A, 7B, and 7C. FIG. 7A is a drawing that shows an example in which the road category that serves as the distribution target of the traffic information is set in correspondence with a case where at least one of the distance and the required travel time from the vehicle position to a destination is long. FIG. 7B is a drawing that shows an example in which the road category that serves as the distribution target of the traffic information is set in correspondence with a case where at least one of the distance and the required travel time from the vehicle position to a destination is medium long. FIG. 7C is a drawing that shows an example in which the road category that serves as the distribution target of the traffic information is set in correspondence with a case where at least one of the distance and the required travel time from the vehicle position to a destination is short.

As shown in FIG. 7A, in a case where at least one of the distance and the required travel time from the vehicle position indicated by the vehicle position mark 51 to a destination 67 is long (e.g., equal to or longer than 100 kilometers/equal to or longer than 2 hours), the CPU 11 sets, as the road category that serves as the distribution target of the traffic information, national routes 68 and 69 as well as an urban expressway 70. Also, the CPU 11 sets a basic distribution range 71 having an area of 30 kilometers squared on the search route in a forward direction of the vehicle position mark 51.

As shown in FIG. 7B, in a case where at least one of the distance and the required travel time from the vehicle position indicated by the vehicle position mark 51 to a destination 73 is medium long (e.g., equal to or longer than 30 kilometers and shorter than 100 kilometers/equal to or longer than 45 minutes and shorter than 2 hours), the CPU 11 sets, as the road category that serves as the distribution target of the traffic information, national routes 74 and 75 as well as a national expressway 76 and prefectural roads 77. Also, the CPU 11 sets the basic distribution range 71 having an area of 30 kilometers squared on the search route in a forward direction of the vehicle position mark 51.

As shown in FIG. 7C, in a case where at least one of the distance and the required travel time from the vehicle position indicated by the vehicle position mark 51 to a destination 79 is short (e.g., shorter than 30 kilometers/shorter than 45 minutes), the CPU 11 sets, as the road category that serves as the distribution target of the traffic information, all the roads including national routes 80 and 81, an urban expressway 82, prefectural roads 83, city roads 85, and a town road 86. Also, the CPU 11 sets the basic distribution range 71 having an area of 30 kilometers squared on the search route in a forward direction of the vehicle position mark 51.

Subsequently, as shown in FIG. 3, at S114, the CPU 11 performs a judging process to judge, based on the situations of the roads within the basic distribution range that has been set at S112, whether or not the basic distribution range includes any distribution range that contains no roads, in other words, whether or not the basic distribution range includes any distribution range that contains no links. In a case where the basic distribution range does not include any distribution range that contains no links (S114: NO), the CPU 11 proceeds to the process at S116.

On the contrary, in a case where the basic distribution range includes one or more distribution ranges that contain no links (S114: YES), the CPU 11 proceeds to the process at S115. At S115, the CPU 11 sets a changed distribution range by changing the basic distribution range so that the one or more distribution ranges within the basic distribution range that contain no links are excluded. The CPU 11 then stores the changed distribution range into the RAM 12. For example, the CPU 11 sets the changed distribution range by changing the angle of the distribution direction of the basic distribution range so that the one or more distribution ranges that contain no links are excluded, before storing the changed distribution range into the RAM 12.

As another example, the CPU 11 sets the changed distribution range by reducing the width of the basic distribution range in a left-and-right direction or in a forward-and-backward direction so that the one or more distribution ranges that contain no links are excluded, before storing the changed distribution range into the RAM 12. As yet another example, the CPU 11 sets the changed distribution range by dividing the basic distribution range into sections in a left-and-right direction so that the one or more distribution ranges that contain no links are excluded, before storing the changed distribution range into the RAM 12. In addition, the CPU 11 reads the changed distribution range flag from the RAM 12 and assigns "1" to the read changed distribution range flag, before storing the changed distribution range flag back into the RAM 12. After that, the CPU 11 proceeds to the process at S116.

Next, examples in which a changed distribution range is set by changing the basic distribution range so that the one or more distribution ranges that contain no links are excluded will be explained with reference to FIGS. 8A, 8B, and 8C. FIG. 5A is a drawing that shows an example in which a changed distribution range is set by reducing the width of a basic distribution range in a left-and-right direction so that distribution ranges that contain no links are excluded. FIG. 8B is a drawing that shows another example in which a changed distribution range is set by changing a distribution direction of a basic distribution range so that a distribution range that contains no links is excluded. FIG. 8C is a drawing that shows yet another example in which changed distribution ranges are set by dividing a basic distribution range into sections in a left-and-right direction so that a distribution range that contains no links is excluded.

Figure 8A:
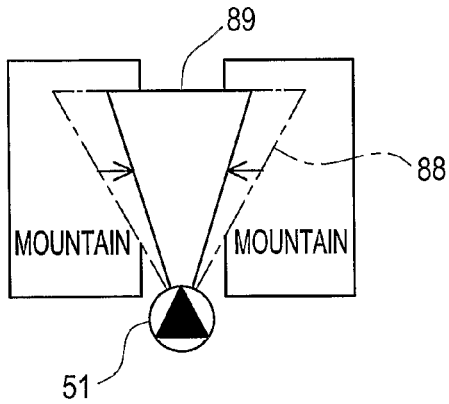
FIG. 8A is a drawing that shows an example in which a changed distribution range is set by reducing the width of a basic distribution range in a left-and-right direction so that distribution ranges that contain no links are excluded.
Figure 8B:
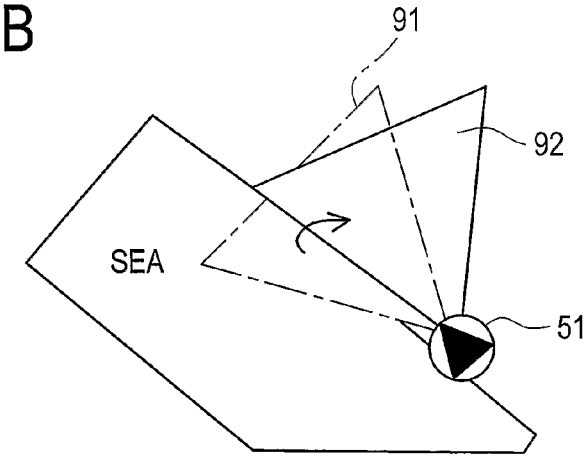
FIG. 8B is a drawing that shows another example in which a changed distribution range is set by changing a distribution direction of a basic distribution range so that a distribution range that contains no links is excluded.
Figure 8C:
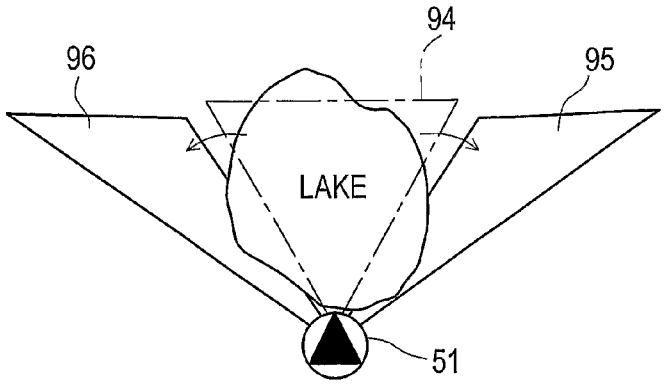
FIG. 8C is a drawing that shows yet another example in which changed distribution ranges are set by dividing a basic distribution range into sections in a left-and-right direction so that a distribution range that contains no links is excluded.

As shown in FIG. 8A, in a case where the vehicle position is located on a road in a mountainous area, the CPU 11 sets a changed distribution range 89 by reducing the width of a basic distribution range 88 in a left-and-right direction so that such parts of the basic distribution range 88 positioned in a forward direction of the vehicle position mark 51 that overlap the mountain are excluded, in other words, so that such parts that contain no links are excluded. The CPU 11 then stores the changed distribution range 89 into the RAM 12.

As another example, as shown in FIG. 88, in a case where the vehicle position is located on a road on a sea coast, the CPU 11 sets a changed distribution range 92 that has land as the distribution target by changing the distribution direction of a basic distribution range 91 toward the inland by a predetermined angle so that such a part of the basic distribution range 91 positioned in a forward direction of the vehicle position mark 51 that overlaps the sea is excluded, in other words, so that such a part that contains no links is excluded. The CPU 11 then stores the changed distribution range 92 into the RAM 12.

As yet another example, as shown in FIG. 8C, in a case where the vehicle position is located on a lake shore facing a lake, the CPU 11 sets changed distribution ranges 95 and 96 that have land as the distribution target by dividing a basic distribution range 94 into sections in a left-and-right direction so that such a part of the basic distribution range 94 positioned in a forward direction of the vehicle position mark 51 that overlaps the lake is excluded, in other words, so that such a part that contains no links is excluded. The CPU 11 then stores the changed distribution ranges 95 and 96 into the RAM 12.

Subsequently, as shown in FIG. 3, at S116, the CPU 11 performs a judging process to judge, based on the situations of the roads within the basic distribution range that has been set at S112, whether or not there is a road to drive from a vehicle position surrounding area (e.g., an area of 2 to 6 kilometers squared in which the vehicle position is located at the center thereof) to a road within the basic distribution range, in other words, whether or not the vehicle position surrounding area (e.g., an area of 2 to 6 kilometers squared in which the vehicle position is located at the center thereof) contains as many drivable links as, or more drivable links than, a predetermined number (e.g., 3 to 5). In a case where the vehicle position surrounding area contains fewer drivable links than the predetermined number (S116: NO), the CPU 11 proceeds to the process at S118.

On the contrary, in a case where the vehicle position surrounding area contains as many drivable links as, or more drivable links than, the predetermined number (S116: YES), the CPU 11 proceeds to the process at S117. At S117, the CPU 11 sets a changed distribution range by changing the basic distribution range so that the vehicle position surrounding area is included in the changed distribution range. The CPU 11 then stores the changed distribution range into the RAM 12. As an example, the CPU 11 sets the changed distribution range by adding the vehicle position surrounding area to the basic distribution range. As another example, the CPU 11 sets the changed distribution range by moving the basic distribution range so that the vehicle position surrounding area is included in the changed distribution range.

In addition, the CPU 11 reads the changed distribution range flag from the RAM 12 and assigns "1" to the read changed distribution range flag, before storing the changed distribution range flag back into the RAM 12. After that, the CPU 11 proceeds to the process at S118.

Figure 9:
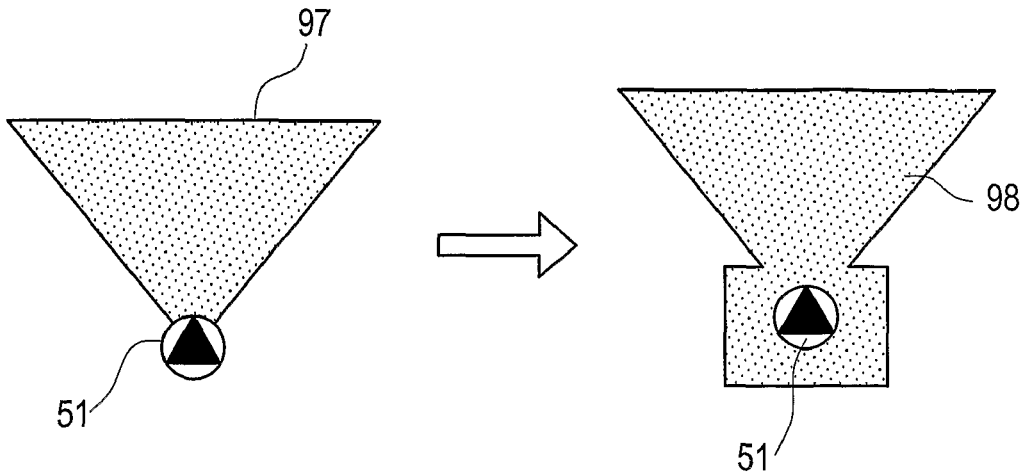
FIG. 9 is a thawing that shows an example in which a changed distribution range is set by adding a vehicle position surrounding area to a basic distribution range.
Figure 10:
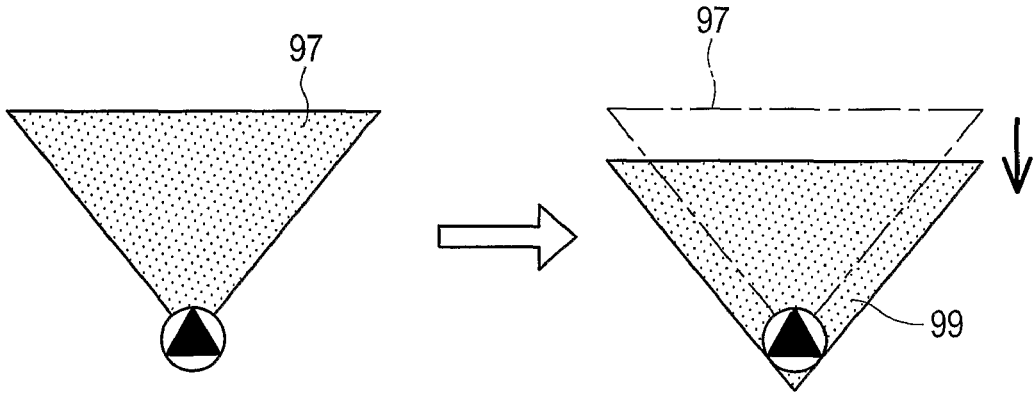
FIG. 10 is a drawing that shows an example in which a changed distribution range is set by moving a basic distribution range so that a vehicle position surrounding area is included in the changed distribution range.

Next, examples in which a changed distribution range is set by changing a basic distribution range so that the vehicle position surrounding area is included in the changed distribution range will be explained with reference to FIGS. 9 and 10. FIG. 9 is a drawing that shows an example in which a changed distribution range is set by adding a vehicle position surrounding area to a basic distribution range. FIG. 10 is a drawing that shows an example in which a changed distribution range is set by moving a basic distribution range so that a vehicle position surrounding area is included in the changed distribution area.

As an example, as shown in FIG. 9, the CPU 11 sets a changed distribution range 98 by adding a distribution range having an area of approximately 2 to 6 kilometers squared in which the vehicle position is located at the center thereof, to a basic distribution range 97 that is positioned in a forward direction of the vehicle position mark 51. The CPU 11 thereby enlarges the distribution range so that the vehicle position surrounding area is included.

As another example, as shown in FIG. 10, the CPU 11 sets a changed distribution range 99 by moving the basic distribution range 97 positioned in a forward direction of the vehicle position mark 51 toward the position of the vehicle by a number of kilometers (e.g., approximately 2 to 6 kilometers). The CPU 11 thereby enlarges the distribution range in the vehicle position surrounding area.

Subsequently, as shown in FIG. 3, at S118, the CPU 11 performs a sub-process of the "distribution range changing process" to set the changed distribution range by changing the basic distribution range, based on the situations of the roads within the basic distribution range, in other words, based on, for example, the information amount of the traffic information that corresponds to the situations of the roads.

Next, the sub-process of the "distribution range changing process" will be explained, with reference to FIG. 5. As shown in FIG. 5, at S311, the CPU 11 calculates a proportion of congested links to all the links that serve as the distribution target within the basic distribution range, based on the current traffic information 16A and the statistical traffic information 16B that correspond to the situations of the roads within the basic distribution range. The CPU 11 then performs a judging process to judge whether or not the proportion of the congested links exceeds a predetermined value (e.g., 50%).

In a case where the proportion of the congested links is equal to or lower than the predetermined value (e.g., 50%) (S311: NO), the CPU 11 proceeds to the process at S313.

On the contrary, in a case where the proportion of the congested links exceeds the predetermined value (e.g., 50%) (S311: YES), the CPU 11 proceeds to the process at S312. At S312, the CPU 11 sets a changed distribution range by reducing the basic distribution range in an inward direction because the communication amount of the traffic information that corresponds to the basic distribution range is large. The CPU 11 then stores the changed distribution range into the RAM 12. As an example, the CPU 11 sets a changed distribution range by reducing a basic distribution range in an inward direction while the vehicle position is located at the center thereof and stores the changed distribution range into the RAM 12. As another example, the CPU 11 sets a changed distribution range by reducing a basic distribution range in an inward direction so that the vehicle position and a reference position that serves as a reference for the direction of the destination are included in the changed distribution range and stores the changed distribution range into the RAM 12.

In addition, the CPU 11 reads the changed distribution range flag from the RAM 12 and assigns "1" to the read changed distribution range flag, before storing the changed distribution range flag back into the RAM 12. After that, the CPU 11 proceeds to the process at S313.

Figure 11A:
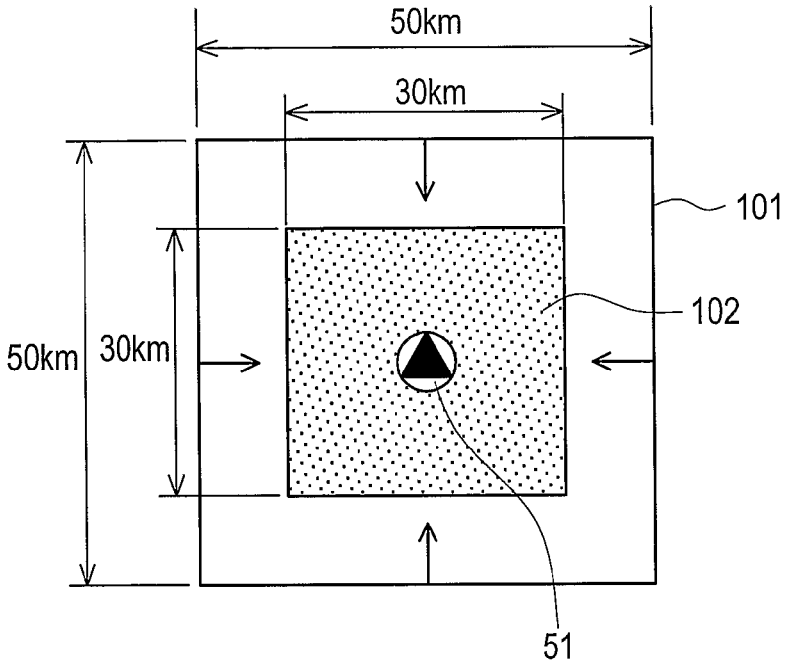
FIG. 11A is a drawing that shows an example in which a changed distribution range is set by reducing a basic distribution range while the vehicle position is located at the center thereof.
Figure 11B:
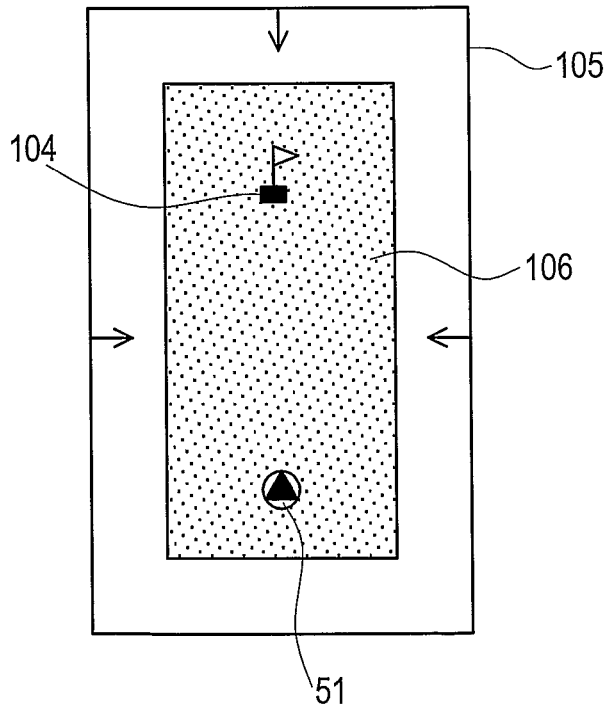
FIG. 11B is a drawing that shows an example in which a changed distribution range is set by reducing a basic distribution range so that the vehicle position and a reference position serving as a reference for the direction of a destination are included in the changed distribution range.

Next, examples in which a changed distribution range is set by reducing a basic distribution range will be explained with reference to FIGS. 11A and 11B. FIG. 11A is a drawing that shows an example in which a changed distribution range is set by reducing a basic distribution range while the vehicle position is located at the center thereof. FIG. 11B is a drawing that shows an example in which a changed distribution range is set by reducing a basic distribution range so that the vehicle position and a reference position serving as a reference for the direction of a destination are included in the changed distribution range.

As an example, as shown in FIG. 11A, the CPU 11 sets a changed distribution range 102 by reducing a basic distribution range 101 having an area of 50 kilometers squared in which the vehicle position mark 51 indicating the vehicle position is located at the center thereof, so as to be an area of 30 kilometers squared in which the vehicle position mark 51 is located at the center thereof. The CPU 11 then stores the changed distribution range 102 into the RAM 12. As another example, as shown in FIG. 11B, the CPU 11 sets a changed distribution range 106 by reducing a basic distribution range 105 that includes the vehicle position mark 51 indicating the vehicle position and a reference position 104 serving as a reference for the direction of the destination, in an inward direction along the route so that the vehicle position mark 51 and the reference position 104 are included in the changed distribution range 106. The CPU 11 then stores the changed distribution range 106 into the RAM 12.

Subsequently, as shown in FIG. 5, at S313, the CPU 11 performs a judging process to judge whether or not the proportion of the congested links calculated at S311 is equal to or lower than a predetermined value (e.g., 10%). In a case where the proportion of the congested links exceeds the predetermined value (e.g., 10%) (S313: NO), the CPU 11 proceeds to the process at S315.

On the contrary, in a case where the proportion of the congested links to all the links within the basic distribution range is equal to or lower than the predetermined value (e.g., 10%) (S313: YES), the CPU 11 proceeds to the process at S314. At S314, the CPU 11 sets a changed distribution range by enlarging the basic distribution range in an outward direction because there is room in the communication amount of the traffic information that corresponds to the basic distribution range. The CPU 11 then stores the changed distribution range into the RAM 12.

As an example, the CPU 11 sets a changed distribution range by enlarging a basic distribution range in an outward direction while the vehicle position is located in the center thereof and stores the changed distribution range into the RAM 12. As another example, the CPU 11 sets a changed distribution range by enlarging a basic distribution range in an outward direction so that the vehicle position and the reference position that serves as a reference for the direction of the destination are included in the changed distribution range and stores the changed distribution range into the RAM 12.

In addition, the CPU 11 reads the changed distribution range flag from the RAM 12 and assigns "1" to the read changed distribution range flag, before storing the changed distribution range flag back into the RAM 12. After that, the CPU 11 proceeds to the process at S315.

Figure 12A:
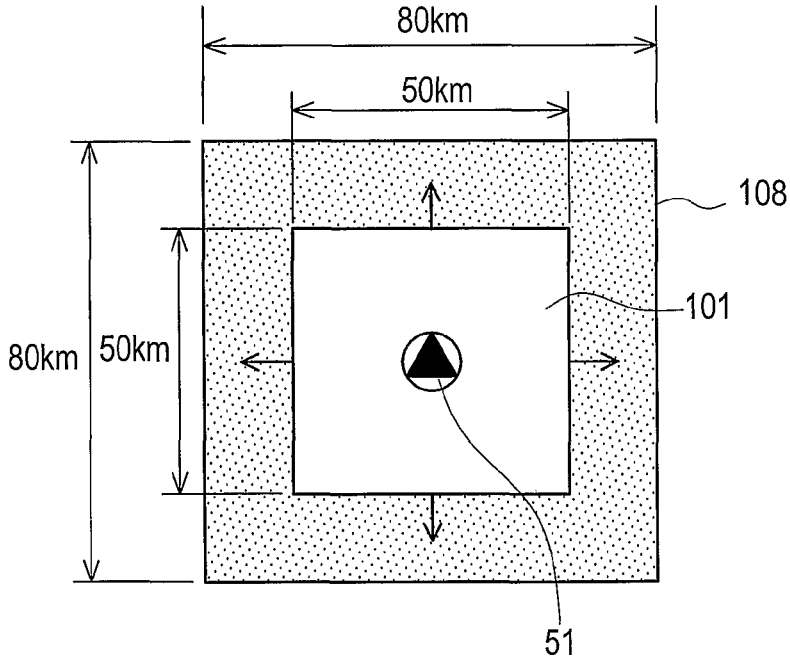
FIG. 12A is a drawing that shows an example in which a changed distribution range is set by enlarging a basic distribution range while the vehicle position is located at the center thereof.
Figure 12B:
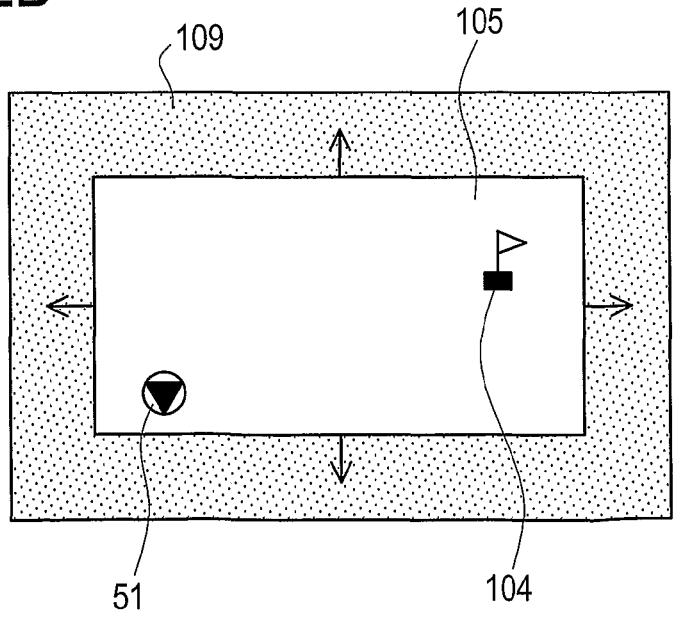
FIG. 12B is a drawing that shows an example in which a changed distribution range is set by enlarging a basic distribution range so that the vehicle position and a reference position serving as a reference for the direction of a destination are included.

Next, examples in which a changed distribution range is set by enlarging a basic distribution range will be explained with reference to FIGS. 12A and 12B. FIG. 12A is a drawing that shows an example in which a changed distribution range is set by enlarging a basic distribution range while the vehicle position is located at the center thereof. FIG. 12B is a drawing that shows an example in which a changed distribution range is set by enlarging a basic distribution range so that the vehicle position and a reference position serving as a reference for the direction of a destination are included in the changed distribution range.

As an example, as shown in FIG. 12A, the CPU 11 sets a changed distribution range 108 by enlarging a basic distribution range 101 having an area of 50 kilometers squared in which the vehicle position mark 51 indicating the vehicle position is located at the center thereof, so as to be an area of 80 kilometers squared in which the vehicle position mark 51 is located at the center thereof. The CPU 11 then stores the changed distribution range 108 into the RAM 12. As another example, as shown in FIG. 12B, the CPU 11 sets a changed distribution range 109 by enlarging a basic distribution range 105 that includes the vehicle position mark 51 indicating the vehicle position and a reference position 104 that serves as a reference for the direction of the destination, in an outward direction along the route so that the vehicle position mark 51 and the reference position 104 are included in the changed distribution range 109. The CPU 11 then stores the changed distribution range 109 into the RAM 12.

Subsequently, as shown in FIG. 5, at S315, the CPU 11 reads time data and the like from the timer 19 and obtains a current date and a current time. Thus, the CPU 11 identifies factors related to the day of the week and the time period of the day corresponding to the current point in time and stores the identified factors into the RAM 12. After that, the CPU 11 performs a judging process to judge, based on the traffic information 16A, 16B, and the like, whether or not the time period corresponding to the current point in time is a time period during which the roads within the basic distribution range that has been set at S112 are likely to be congested.

In a case where it has been judged that the time period corresponding to the current point in time is not a time period during which the roads within the basic distribution range are likely to be congested (S315: NO), the CPU 11 proceeds to the process at S317.

On the contrary, in a case where it has been judged that the time period corresponding to the current point in time is a time period during which the roads within the basic distribution range are likely to be congested (S315: YES), the CPU 11 proceeds to the process at S316. For example, the time period corresponding to the current point in time is a commuting time period in the morning or the evening, the CPU 11 judges that the current point in time is in a time period during which the roads within the basic distribution range are likely to be congested and proceeds to the process at S316. At S316, the CPU 11 performs the process at S312 because the communication amount of the traffic information that corresponds to the basic distribution range is large and proceeds to the process at S317.

Subsequently, at S317, the CPU 11 performs a judging process to judge, based on the traffic information 16A, 16B, and the like, whether or not the time period corresponding to the current point in time that has been stored in the RAM 12 at S315 is a time period during which the roads within the basic distribution range that has been set at S112 are not likely to be congested.

In a case where it has been judged that the time period corresponding to the current point in time is a time period during which the roads within the basic distribution range are not likely to be congested, (S317: NO), the CPU 11 proceeds to the process at S319.

On the contrary, in a case where it has been judged that the time period corresponding to the current point in time is a time period during which the roads within the basic distribution range are not likely to be congested, (S317: YES), the CPU 11 proceeds to the process at S318. For example, in a case where the time period corresponding to the current point in time is in the middle of the night, the CPU 11 judges that the current point in time is in a time period during which the roads within the basic distribution range are not likely to be congested and proceeds to the process at S318. At S318, the CPU 11 performs the process at S314 because there is room in the communication amount of the traffic information that corresponds to the basic distribution range and proceeds to the process at S319.

Subsequently, at S319, the CPU 11 performs a judging process to judge whether or not the route search criterion that has been received gives a priority to at least one of recommended roads and toll roads. In a case where it has been judged that the received route search criterion does not give a priority to either the recommended roads or the toll roads (S319: NO), the CPU 11 proceeds to the process at S321.

On the contrary, in a case where it has been judged that the received route search criterion gives a priority to at least one of the recommended roads and the toll roads (S319: YES), the CPU 11 proceeds to the process at S320. At S320, in a case where the route search criterion gives a priority to at least one of the recommended roads and the toll roads, because there is a possibility that the basic route may extend further, the CPU 11 sets a changed distribution range by enlarging the basic distribution range in an outward direction along the basic route. The CPU 11 then stores the changed distribution range into the RAM 12.

In addition, the CPU 11 reads the changed distribution range flag from the RAM 12 and assigns "1" to the read changed distribution range flag, before storing the changed distribution range flag back into the RAM 12. The CPU 11 then proceeds to the process at S321.

Figure 13A:
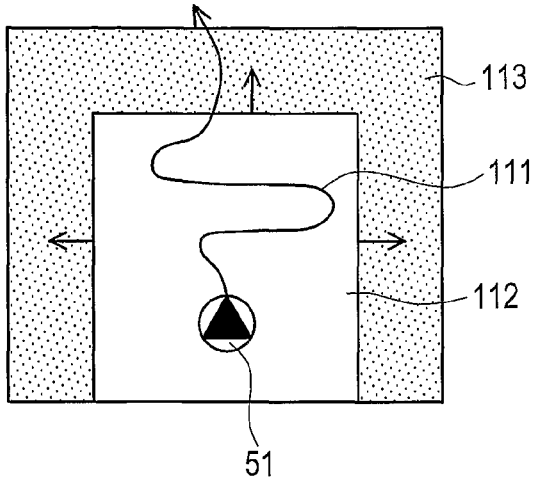
FIG. 13A is a drawing that shows an example in which a changed distribution range is set by enlarging a basic distribution range in an outward direction along a basic route positioned in a forward direction of the vehicle position.
Figure 13B:
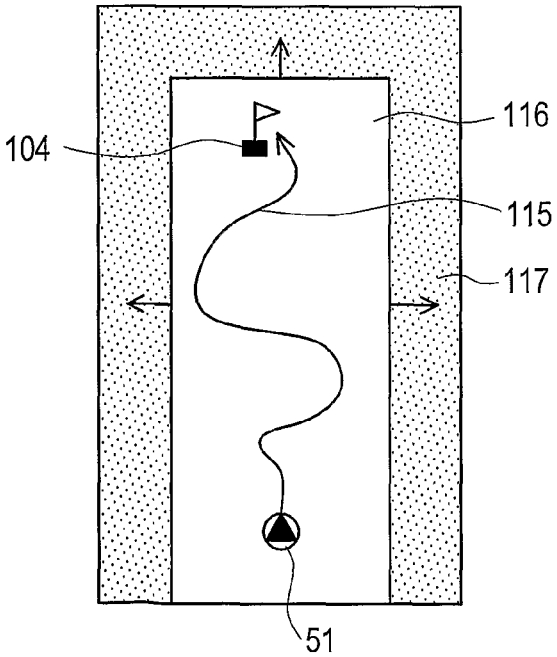
FIG. 13B is a drawing that shows an example in which a changed distribution range is set by enlarging a basic distribution range in an outward direction along a basic route that includes the vehicle position and a reference position serving as a reference for the direction of a destination.

Next, examples in which a changed distribution range is set by enlarging a basic distribution range along a basic route will be explained with reference to FIGS. 13A and 13B. FIG. 13A is a drawing that shows an example in which a changed distribution range is set by enlarging a basic distribution range in an outward direction along a basic route positioned in a forward direction of the vehicle position. FIG. 13B is a drawing that shows an example in which a changed distribution range is set by enlarging a basic distribution range in an outward direction along a basic route that includes the vehicle position and a reference position serving as a reference for the direction of a destination.

As an example, as shown in FIG. 13A, in a case where the route search criterion gives a priority to at least one of the recommended roads and the toll roads, because there is a possibility that a basic route 111 may extend further, the CPU 11 sets a changed distribution range 113 by enlarging, in an outward direction, a distribution range within a basic distribution range 112 that is positioned in a forward direction of the vehicle position indicated by the vehicle position mark 51. The CPU 11 then stores the changed distribution range 113 into the RAM 12.

As another example, as shown in FIG. 13B, in a case where the route search criterion gives a priority to at least one of the recommended roads and the toll roads, because there is a possibility that a basic route 115 from the vehicle position indicated by the vehicle position mark 51 to the reference position 104 that serves as a reference for the direction of the destination may extend further, the CPU 11 sets a changed distribution range 117 by enlarging a basic distribution range 116 that includes the vehicle position mark 51 and the reference position 104 in an outward direction. The CPU 11 then stores the changed distribution range 117 into the RAM 12.

Subsequently, as shown in FIG. 5, at S321, the CPU 11 performs a judging process to judge whether or not the received route search criterion gives a priority to at least one of the distance and general roads. In a case where it has been judged that the received route search criterion does not give a priority to either the distance or general roads (S321: NO), the CPU 11 proceeds to the process at S323.

On the contrary, in a case where it has been judged that the received route search criterion gives a priority to at least one of the distance and general roads (S321: YES), the CPU 11 proceeds to the process at S322. At S322, in the case where the route search criterion gives a priority to at least one of the distance and the general roads, because the basic route extends substantially straight to the destination, the CPU 11 sets a changed distribution range by reducing the basic distribution range in an inward direction along the basic route. The CPU 11 then stores the changed distribution range into the RAM 12.

In addition, the CPU 11 reads the changed distribution range flag from the RAM 12 and assigns "1" to the read changed distribution range flag, before storing the changed distribution range flag back into the RAM 12. After that, the CPU 11 proceeds to the process at S323.

Figure 14A:
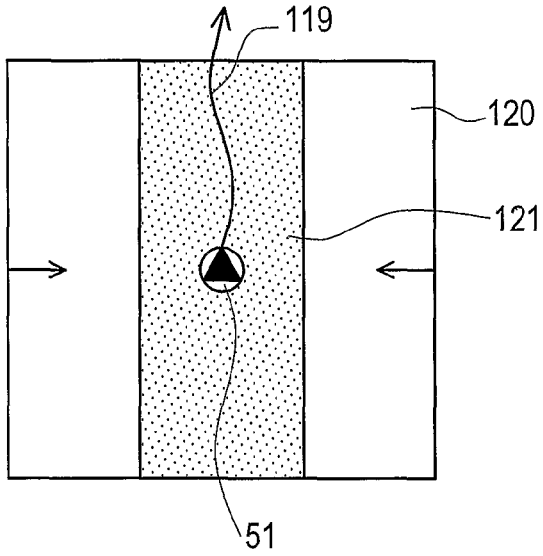
FIG. 14A is a drawing that shows an example in which a changed distribution range is set by reducing a basic distribution range inward in a left-and-right width direction along a basic route, while the vehicle position is located at the center thereof.
Figure 14B:
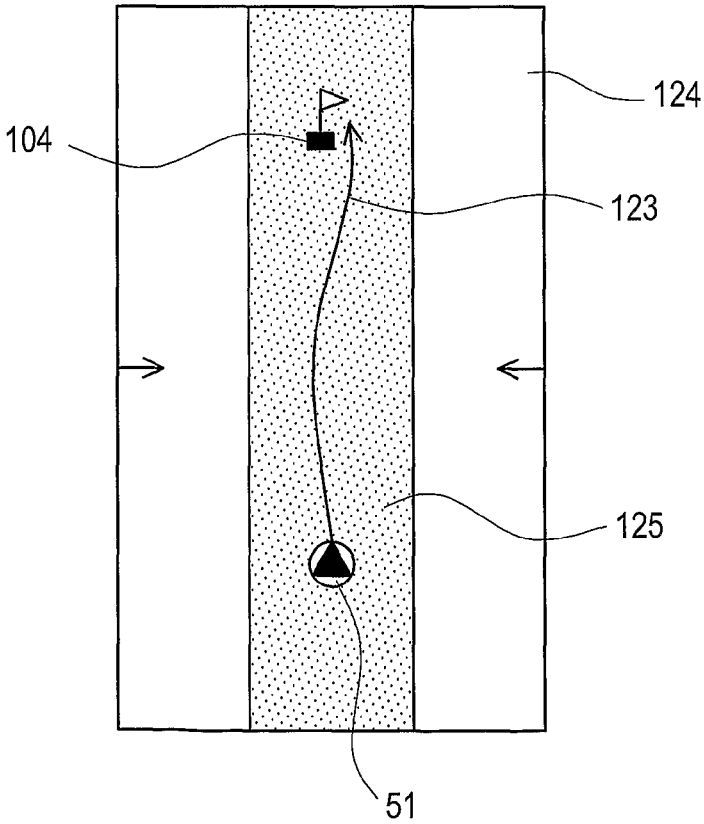
FIG. 14B is a drawing that shows an example in which a changed distribution range is set by reducing a basic distribution range inward in a left-and-right width direction along a basic route, the basic distribution range including the vehicle position and a reference position serving as a reference for the direction of a destination.

Next, examples in which a changed distribution range is set by reducing a basic distribution range in an inward direction along a basic route will be explained, with reference to FIGS. 14A and 14B. FIG. 14A is a drawing that shows an example in which a changed distribution range is set by reducing a basic distribution range inward in a left-and-right width direction along a basic route, while the vehicle position is located at the center thereof. FIG. 14B is a drawing that shows an example in which a changed distribution range is set by reducing a basic distribution range inward in a left-and-right width direction along a basic route, the basic distribution range including the vehicle position and a reference position serving as a reference for the direction of a destination.

As an example, as shown in FIG. 14A, in a case where the route search criterion gives a priority to at least one of the distance and general roads, because a basic route 119 extends substantially straight from the vehicle position indicated by the vehicle position mark 51 to the destination, the CPU 11 sets a changed distribution range 121 by reducing a basic distribution range 120 in an inward direction along the basic route 119, in other words, inward in a left-and-right width direction. The CPU 11 then stores the changed distribution range 121 into the RAM 12.

As another example, as shown in FIG. 14B, in a case where the route search criterion gives a priority to at least one of the distance and the general roads, because a basic route 123 extends substantially straight from the vehicle position mark 51 indicating the vehicle position to the reference position 104 that serves as a reference for the direction of the destination, the CPU 11 sets a changed distribution range 125 by reducing a basic distribution range 124 in an inward direction along the basic route 123, in other words, inward in a left-and-right width direction. The CPU 11 then stores the changed distribution range 125 into the RAM 12.

Subsequently, as shown in FIG. 5, at S323, the CPU 11 performs a judging process to judge, based on the situations of the roads within the basic distribution range that has been set at S112, in other words, based on the current traffic information 16A that corresponds to the situations of the roads, whether or not there is information related to a traffic obstruction such as accident information or traffic control information along the basic route within the basic distribution range, in other words, whether or not there is a traffic obstruction such as an accident or traffic control within the basic distribution range.

In a case where it has been judged that there is no traffic obstruction such as an accident or traffic control within the basic distribution range (S323: NO), the CPU 11 ends the sub-process and returns to the main flowchart so as to proceed to the process at S119.

On the contrary, in a case where it has been judged that there is a traffic obstruction such as an accident or traffic control within the basic distribution range (S323: YES), the CPU 11 proceeds to the process at S324. At S324, in the case where there is a traffic obstruction such as an accident or traffic control within the basic distribution range, because there is a possibility that a detour needs to be taken and the route becomes longer in distance, the CPU 11 sets a changed distribution range by enlarging the basic distribution range in an outward direction. The CPU 11 then stores the changed distribution range into the RAM 12.

In addition, the CPU 11 reads the changed distribution range flag from the RAM 12 and assigns "1" to the read changed distribution range flag, before storing the changed distribution range flag back into the RAM 12. After that, the CPU 11 ends the sub-process and returns to the main flowchart so as to proceed to the process at S119.

Figure 15A:
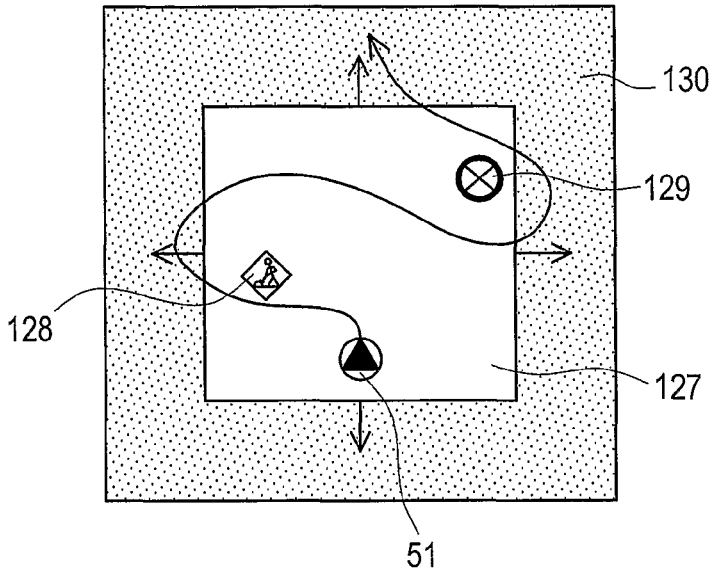
FIG. 15A is a drawing that shows an example in which a changed distribution range is set by enlarging a basic distribution range in an outward direction, in a case where there is a traffic obstruction in a forward direction of the vehicle position within the basic distribution range.
Figure 15B:
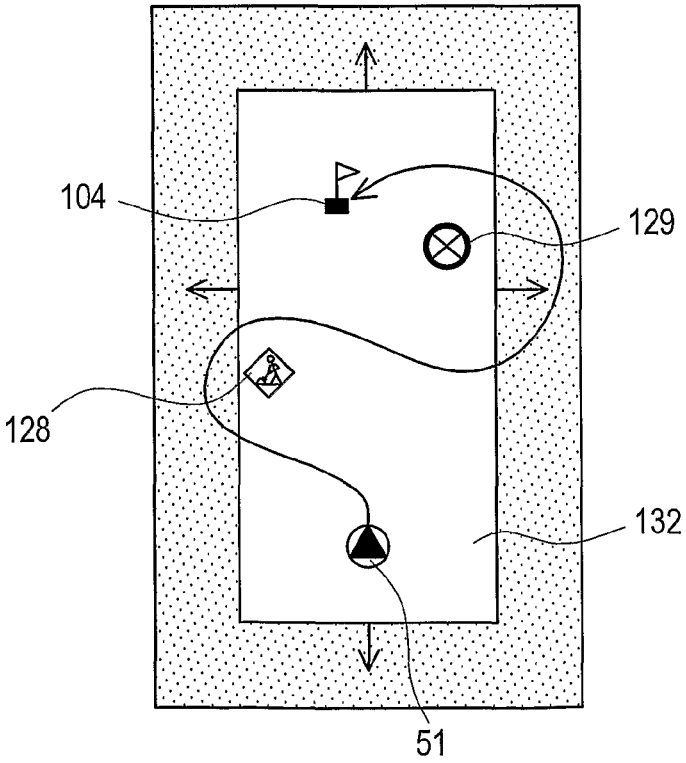
FIG. 15B is a drawing that shows an example in which a changed distribution range is set by enlarging a basic distribution range in an outward direction, in a case where there is a traffic obstruction within the basic distribution range between the vehicle position and a reference position serving as a reference for the direction of a destination.

Next, examples in which a changed distribution range is set by enlarging a basic distribution range in an outward direction, in a case where there is a traffic obstruction such as an accident or traffic control within the basic distribution range will be explained with reference to FIGS. 15A and 15B. FIG. 15A is a drawing that shows an example in which a changed distribution range is set by enlarging a basic distribution range in an outward direction, in a case where there is a traffic obstruction in a forward direction of the vehicle position within the basic distribution range. FIG. 15B is a drawing that shows an example in which a changed distribution range is set by enlarging a basic distribution range in an outward direction, in a case where there is a traffic obstruction within the basic distribution range between the vehicle position and a reference position serving as a reference for the direction of a destination.

As an example, as shown in FIG. 15A, in a case where the traffic is controlled due to a road construction 128 and the road is closed (shown with the reference character 129) due to an accident, in a forward direction of the vehicle position indicated by the vehicle position mark 51 within a basic distribution range 127, the CPU 11 sets a changed distribution range 130 by enlarging the basic distribution range 127 in an outward direction (e.g., enlarging the basic distribution range 127 by 30 kilometers in each of the four directions). The CPU 11 then stores the changed distribution range 130 into the RAM 12.

As another example, as shown in FIG. 15B, in a case where the traffic is controlled due to a road construction 128 and the road is closed (shown with the reference character 129) due to an accident, between the vehicle position indicated by the vehicle position mark 51 and the reference position 104 serving as a reference for the direction of the destination, within a basic distribution range 132, the CPU 11 sets a changed distribution range 133 by enlarging the basic distribution range 132 in an outward direction (e.g., enlarging the basic distribution range 132 by 30 kilometers in each of the four directions). The CPU 11 then stores the changed distribution range 133 into the RAM 12.

Subsequently, as shown in FIG. 3, at S119, the CPU 11 reads the changed distribution range flag from the RAM 12. In a case where the read changed distribution range flag is "0", the basic distribution range that has been set at S112 is used as the distribution target of the traffic information. The CPU 11 extracts the current traffic information 16A and the like including the congestion information and the traffic control information that correspond to the road category that has been set at S113. The CPU 11 then stores the extracted information into the RAM 12, as distributed traffic information that is information to be distributed to the navigation apparatus 2.

Alternatively, after the CPU 11 reads the changed distribution range flag from the RAM 12, in a case where the read changed distribution range flag is "1", the changed distribution range that has been set at S115, S117, or S118 is used as the distribution target of the traffic information. The CPU 11 extracts the current traffic information 16A and the like including the congestion information and the traffic control information that correspond to the road category that has been set at S113. The CPU 11 then stores the extracted information into the RAM 12, as distributed traffic information that is information to be distributed to the navigation apparatus 2.

At S120, the CPU 11 distributes the distributed traffic information to the navigation apparatus 2 that corresponds to the navigator identifying ID that has been received at S111 as described above. The CPU 11 then ends the process.

As explained in detail above, in the navigation system 1 according to the present embodiment, when the CPU 11 provided in the information distribution center 3 has received, from the navigation apparatus 2, the vehicle information such as the navigator identifying ID, the coordinate data of the vehicle position, the coordinate data of the destination, and the route search criterion, together with the request command for requesting the traffic information such as the current traffic information 16A and the like including the congestion information and the traffic control information, the CPU 11 sets the road category that serves as the distribution target of the traffic information based on one of the distance and the required travel time from the vehicle position to the destination (S213 through S219). Subsequently, the CPU 11 extracts the current traffic information 16A and the like including the congestion information and the traffic control information that correspond to the road category that has been set and distributes the extracted information to the navigation apparatus (S119 through S120).

As a result, based on the vehicle information received from the navigation apparatus 2, the CPU 11 sets the road category (e.g., "high-standard roads", "prefectural roads and larger roads", or "all the roads") according to the one of the distance and the required travel time from the vehicle position to the destination. Thus, it is possible to set the road category appropriately in correspondence with the situation of the vehicle in which the navigation apparatus 2 is installed. Consequently, it is possible to eliminate the traffic information that corresponds to the unnecessary road categories and thereby to keep the communication cost at a low level, while ensuring that a sufficient amount of current traffic information 16A and the like is distributed to the navigation apparatus 2.

Further, in the case where the CPU 11 has judged that the vehicle in which the navigation apparatus 2 is installed is positioned on one of what is called an expressway and a toll road, the CPU 11 sets, as the road category that serves as the distribution target of the traffic information such as the current traffic information 16A and the like including the congestion information and the traffic control information, the one of the expressway and the toll road as well as all the roads including the small streets and any larger roads that are located in the surrounding area of an exit of the one of the expressway and the toll road. Also, the CPU 11 sets the route on the one of the expressway and the toll road as well as the surrounding area of the exit of the one of the expressway and the toll road as a changed distribution rage (S211: YES through S212).

As a result, the CPU 11 distributes, to the navigation apparatus 2, the current traffic information 16A and the like including the congestion information and the traffic control information of the route on the one of the expressway and the toll road on which the vehicle is driving as well as the surrounding area of the exit of the one of the expressway and the toll road (S119 through S120). Thus, it is possible to eliminate unnecessary traffic information by a large amount, and thereby to keep the communication cost at an even lower level, while ensuring that a sufficient amount of current traffic information 16A and the like is distributed.

In addition, the CPU 11 reads the time data and the like from the timer 19 and obtains the current date and the current time. Thus, the CPU 11 identifies the factors related to the day of the week and the time period of the day corresponding to the current point in time. In the case where the CPU 11 has judged that the time period corresponding to the current point in time is a time period during which the roads within the basic distribution range are likely to be congested, the CPU 11 sets the changed distribution range by reducing the basic distribution range in an inward direction (S315: YES through S316). On the contrary, in the case where the CPU 11 has judged that the time period corresponding to the current point in time is a time period during which the roads within the basic distribution range are not likely to be congested, the CPU 11 sets the changed distribution range by enlarging the basic distribution range in an outward direction (S317: YES through S318).

As a result, the CPU 11 is able to set the distribution range that serves as the distribution target of the current traffic information 16A and the like including the congestion information and the traffic control information, while taking the time-related factors such as the time period of the day into consideration. Accordingly, it is possible to set the distribution range for any one of the time periods during which the roads are likely to be congested so that the information amount of the current traffic information 16A and the like is at an appropriate level (e.g., so that the information amount of the current traffic information 16A and the like is at a predetermined level). It is therefore possible to keep the communication cost at a low level, while ensuring that a sufficient amount of current traffic information 16A and the like is distributed.

Further, in the case where the proportion of the congested links to all the links within the basic distribution range exceeds a predetermined value (e.g., 50%), because the communication amount of the traffic information such as the current traffic information 16A including the congestion information and the traffic control information that corresponds to the basic distribution range is large, the CPU 11 sets the changed distribution range by reducing the basic distribution range in an inward direction (S311: YES through S312). On the contrary, in the case where the proportion of the congested links to all the links within the basic distribution range is equal to or lower than the predetermined value (e.g., 10%), the CPU 11 sets the changed distribution range by enlarging the basic distribution range in an outward direction (S313: YES through S314).

As a result, the CPU 11 is able to set the changed distribution range so that the information amount of the current traffic information 16A and the like that are to be distributed to the navigation apparatus 2 is at an appropriate level (e.g., the CPU 11 sets the changed distribution range so that the information amount of the current traffic information 16A and the like is at a predetermined level). Thus, it is possible to keep the communication cost at an even lower level, while ensuring that a sufficient amount of current traffic information 16A and the like is distributed.

Further, in the case where the basic distribution range includes any distribution range that contains no links, the CPU 11 sets the changed distribution range by changing the basic distribution range so that one or more distribution ranges within the basic distribution range that contain no links are excluded (S114: YES through S115).

As a result, the CPU 11 is able to set the changed distribution range so that the distribution ranges that contain no links such as mountainous areas, sea coasts, and lake shores are excluded, while taking the current position of the vehicle and the driving route into consideration. Thus, it is possible to eliminate the current traffic information 16A and the like that correspond to the unnecessary distribution ranges and thereby to keep the communication cost at a low level, while ensuring that a sufficient amount of current traffic information 16A and the like that correspond to a more effective distribution range is distributed.

Furthermore, in the case where the vehicle position surrounding area contains as many drivable links as, or more drivable links than, a predetermined number, the CPU 11 sets the changed distribution range by changing the basic distribution range so that the vehicle position surrounding area is included in the changed distribution range (S116: YES through S117). As a result, because the changed distribution range contains the drivable links that serve as a plurality of routes in the vehicle position surrounding area, the CPU 11 is able to extract and distribute a sufficient amount of current traffic information 16A and the like that is required in order to search for a route.

Moreover, in the case where the CPU 11 has judged that there is a traffic obstruction such as an accident or traffic control within the basic distribution range, because there is a possibility that a detour needs to be taken and the route becomes longer in distance when there is a traffic obstruction such as an accident or traffic control within the basic distribution range, the CPU 11 sets the changed distribution range by enlarging the basic distribution range in an outward direction (S323: YES through S324).

As a result, in the case where there is a traffic obstruction such as an accident or traffic control within the basic distribution range, it is possible to distribute the current traffic information 16A and the like that correspond to the changed distribution range that is larger than the basic distribution range. Thus, it is possible to distribute a sufficient amount of current traffic information 16A and the like to the navigation apparatus 2. Accordingly, with a high level of precision, the navigation apparatus 2 is able to search for a route that goes around, by a large distance, the traffic obstruction such as an accident or traffic control.

Further, in the case where the CPU 11 has judged that the received route search criterion gives a priority to at least one of the recommended roads and the toll roads, because there is a possibility that the basic route may extend further, the CPU 11 sets the changed distribution range by enlarging the basic distribution range in an outward direction along the basic route (S319: YES through S320). As another example, in the case where the CPU 11 has judged that the received route search criterion gives a priority to at least one of the distance and the general roads, because the basic route extends substantially straight to the destination, the CPU 11 sets the changed distribution range by reducing the basic distribution range in an inward direction along the basic route (S321: YES through S322).

As a result, because the CPU 11 sets the changed distribution range based on the route search criterion, the CPU 11 is able to set the changed distribution range by enlarging the basic distribution range in an outward direction, while taking a possible extension of the basic route found in the search into consideration. Thus, it is possible to distribute a sufficient amount of current traffic information 16A and the like to the navigation apparatus 2. Also, in the case where the basic route does not extend very much according to the route search criterion, the CPU 11 is able to set the changed distribution range by reducing the basic distribution range in an inward direction along the route. Thus, it is possible to reduce the information amount of the traffic information that corresponds to the changed distribution range, and thereby to keep the communication cost at an even lower level.

Figure 16:
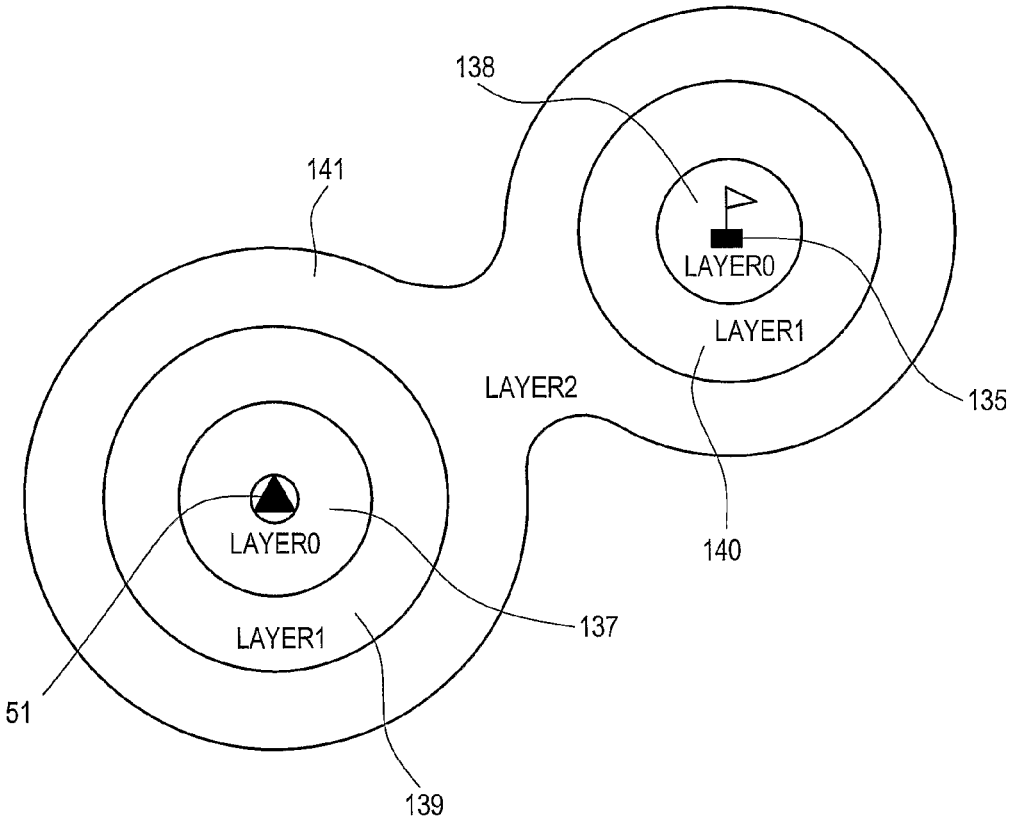
FIG. 16 is a drawing that shows an example where a range in which a route search is to be conducted is arranged so as to have different layers so that a road category that serves as a distribution target of traffic information is set for each of the layers.

The present invention is not limited to the exemplary embodiment described above. Needless to say, it is possible to apply various improvements and modifications to the present invention without departing from the scope of the present invention:

(1) For example, it is acceptable to have an arrangement where a range in which a route search is to be conducted has different layers so that a road category that serves as a distribution target of the traffic information is set for each of the layers. An example of this arrangement will be explained with reference to FIG. 16. FIG. 16 is a drawing that shows an example where a range in which a route search is to be conducted is arranged so as to have different layers so that a road category that serves as a distribution target of the traffic information is set for each of the layers.

As shown in FIG. 16, the CPU 11 sets distribution ranges 137 and 138 that are layers 0 and serve as distribution targets of the current traffic information 16A and the like, in a surrounding area (e.g., within 30 kilometers from the vehicle position located at the center) of the vehicle position indicated by the vehicle position mark 51 and in a surrounding area (e.g., within 30 kilometers from a destination 135 located at the center) of the destination 135, respectively. Also, the CPU 11 sets distribution ranges 139 and 140 that are layers 1 having a predetermined width (e.g., approximately 30 kilometers) and serve as distribution targets of the current traffic information 16A and the like, on the outside of the distribution ranges 137 and 138. Further, the CPU 11 sets a distribution range 141 that is a layer 2 and serves as a distribution target of the current traffic information 16A and the like, so as to surround the outside of the distribution ranges 139 and 140.

The CPU 11 sets a road category that serves as a distribution target for the distribution ranges 137 and 138 as all the roads including the small streets and any larger roads and stores the road category that has been set into the RAM 12. Also, the CPU 11 sets a road category that serves as a distribution target for the distribution ranges 139 and 140 as the prefectural roads and larger roads and stores the road category that has been set into the RAM 12. Further, the CPU 11 sets a road category that serves as a distribution target for the distribution range 141 as the high-standard roads such as national expressways, urban expressways, automobile-only roads, general toll roads, and national routes identified with one-digit and two-digit numbers and stores the road category that has been set into the RAM 12.

Subsequently, the CPU 11 extracts current traffic information 16A that corresponds to each of the road categories for the distribution ranges 137 to 141 and distributes the extracted information to the navigation apparatus 2.

As a result, the CPU 11 distributes the current traffic information 16A and the like that correspond to the road category for each of the layers 0 to 2. Thus, it is possible to distribute the current traffic information 16A and the like that correspond to the route search conducted by the navigation apparatus 2. In addition, because the road category is defined for each of the layers 0 to 2, it is possible to reduce the information amount of the traffic information and thereby to keep the communication cost at a low level, while ensuring that a sufficient amount of current traffic information 16A and the like are distributed to the navigation apparatus 2.

(2) As another modification example, it is acceptable to have an arrangement in which, in the case where a vehicle that is being driven is used as a sensor (called "a probe car") so that the current traffic information 16A and the like including the congestion information is generated based on probe information such as the speed (the time/the position) collected from the probe car, a driving history of each probe car is stored so that information indicating what type of road is preferred by the user of the probe car and whether or not the user wishes to take a detour to go around traffic congestion can be extracted from the driving history. In this situation, at S111, a search is conducted for a basic route that is suitable for the user of each probe car, so that it is possible to set a basic distribution range and a road category that serves as a distribution target of the current traffic information 16A and the like.

With this arrangement, the CPU 11 is able to extract and distribute the current traffic information 16A and the like that are specialized for a specific user, like the user of each probe car. In addition, in order to be able to search for a route that is suitable for the preference of the user of each probe car, the link cost of a location preferred by the user is lowered in the statistical traffic information 16B, so that a basic route is set by conducting a route search based on the statistical traffic information 16B. In this situation, it is possible to extract the current traffic information 16A and the like including the congestion information and the traffic control information and to distribute the extracted information to each probe car.

(3) As yet another modification example, it is acceptable to have an arrangement in which, at S12, the CPU 41 included in the navigation apparatus 2 transmits, to the information distribution center 3, data related to a driving history of the vehicle that is stored in the driving history DB 38, together with the request command for requesting the traffic information such as the current traffic information 16A and the like including the congestion information and the traffic control information. With this arrangement, the CPU 11 provided in the information distribution center 3 is able to extract, out of the data related to the driving history, information indicating what type of road is preferred by the user of the navigation apparatus 2 and whether or not the user wishes to take a detour to go around traffic congestion, based on the data related to the driving history that has been received together with the request command for requesting the traffic information. In this situation, at S111, the CPU 11 is able to extract and distribute the current traffic information 16A and the like that are specialized for the user of the navigation apparatus 2. In addition, in order to be able to search for a route that is suitable for the preference of the user of the navigation apparatus 2, the link cost of a location preferred by the user is lowered in the statistical traffic information 16B, so that a basic route is set by conducting a route search based on the statistical traffic information 16B. In this situation, it is possible to distribute the current traffic information 16A and the like including the congestion information and the traffic control information to the navigation apparatus 2.

(4) As yet another modification example, it is acceptable to have an arrangement in which, at S11, the CPU 41 included in the navigation apparatus 2 performs a judging process to judge whether or not a request button or the like for requesting traffic information has been pushed, the request button being provided in the operating unit 24 realized with, for example, a touch panel or an operation switch. In this situation, in a case where the request button or the like for requesting the traffic information has not been pushed, (S11: NO), the CPU 41 ends the process.

On the contrary, in a case where the request button or the like for requesting the traffic information has been pushed (S11: YES), at S12, the CPU 41 transmits, to the information distribution center 3, the navigator identifying ID, coordinate data of a current position of the vehicle, and the version information of the navigation map information 37A, together with the request command for requesting the traffic information. After that, it is acceptable to have an arrangement in which the CPU 41 performs the process at S13.

Also, in this situation, at S111, the CPU 11 provided in the information distribution center 3 receives the information such as the navigator identifying ID, the coordinate data of the vehicle position, and the version information of the navigation map information 37A, together with the request command for requesting the traffic information that has been transmitted from the navigation apparatus 2. The CPU 11 then stores the received information into the RAM 12. After that, the CPU 11 performs the process at S112.

Subsequently, at S113, the CPU 11 performs the process at S211 as described above. After that, in a case where the CPU 11 has judged that the vehicle in which the navigation apparatus 2 is installed is positioned on one of what is called an expressway and a toll road (S211: YES), the CPU 11 proceeds to the process at S212. At S212, the CPU 11 sets the one of the expressway and the toll road as a road category that serves as the distribution target of the traffic information and stores the road category that has been set into the RAM 12.

Also, the CPU 11 sets the route on the one of the expressway and the toll road as the changed distribution range that is a distribution range serving as the distribution target of the traffic information, in place of the basic distribution range that has been set at S112. The CPU 11 then stores the changed distribution range that has been set into the RAM 12. Further, the CPU 11 reads the changed distribution range flag from the RAM 12 and assigns "1" to the read changed distribution range flag, before storing the changed distribution range flag back into the RAM 12. After that, the CPU 11 returns to the main flowchart.

On the contrary, in the case where the CPU 11 has judged that the vehicle in which the navigation apparatus 2 is installed is not positioned on one of what is called an expressway and a toll road (S211: NO), after performing the process at S213, the CPU 11 returns to the main flowchart without performing the process at S214 through S219.

Subsequently, the CPU 11 performs the process at S114 through S117. After that, at S118, after performing the process at S311 through S318, the CPU 11 returns to the main flowchart without performing the process at S319 through S324. After that, it is acceptable to have an arrangement in which the CPU 11 ends the process after performing the process at S119 through S120.

The invention claimed is:

1. A traffic information distributing apparatus that distributes traffic information, comprising:

a vehicle information receiving unit that receives vehicle information from a navigation apparatus installed in a vehicle;

a road category setting unit that, when the vehicle information indicates that the vehicle is on an expressway or toll road, sets the expressway or toll road on which the vehicle is traveling, together with roads in an area surrounding an exit of the expressway or toll road, as a road type category that serves as a distribution target of the traffic information, based on the vehicle information;

a traffic information extracting unit that extracts only the traffic information that corresponds to the set road type category; and a traffic information distribution controlling unit that controls so as to distribute the extracted traffic information to the navigation apparatus, wherein:

the vehicle information includes vehicle position information that indicates a current position of the vehicle and destination information that indicates a destination, and when the vehicle information indicates that the vehicle is not on an expressway or toll road, the road category setting unit calculates one of a distance and a required travel time from the vehicle position to the destination, based on the vehicle position information and the destination information, judges whether the calculated distance is equal to or longer than a predetermined distance or whether the calculated required travel time is equal to or longer than a predetermined time, and sets the road type category that serves as the distribution target of the traffic information, based on the results of one of the judgments.

2. The traffic information distributing apparatus according to claim 1, further comprising:

a route searching unit that searches for a route, based on the vehicle position information and the destination information.

3. The traffic information distributing apparatus according to claim 1, further comprising:

a time detecting unit that detects a current time;

a basic distribution range setting unit that sets a basic distribution range that serves as a distribution target of the traffic information, based on the vehicle information and the current time;

a time judging unit that judges whether or not the current time is a congestion time during which roads within the basic distribution range are likely to be congested; and a changed distribution range setting unit that changes the basic distribution range and sets a changed distribution range, in a case where the current time is judged as a congestion time by the time judging unit; and wherein the traffic information extracting unit extracts the traffic information that corresponds to the road type category for the changed distribution range.

4. The traffic information distributing apparatus according to claim 1, further comprising:

a basic distribution range setting unit that sets a basic distribution range that serves as a distribution target of the traffic information, based on the vehicle information;

a congested link calculating unit that calculates a proportion of congested links to all links within the basic distribution range, based on traffic information that corresponds to the basic distribution range; and a distribution range changing unit that changes the basic distribution range and sets a changed distribution range, based on the proportion of the congested links to all the links; and wherein the traffic information extracting unit extracts the traffic information that corresponds to the road type category for the changed distribution range.

5. The traffic information distributing apparatus according to claim 4, wherein the distribution range changing unit includes a distribution range judging unit that judges whether or not the basic distribution range includes any distribution range that contains no links, and in a case where the distribution range judging unit has judged that the basic distribution range includes one or more distribution ranges that contain no links, the distribution range changing unit sets the changed distribution range so that the one or more distribution ranges that contain no links are excluded from the changed distribution range.

6. The traffic information distributing apparatus according to claim 4, wherein the vehicle information includes vehicle position information that indicates a current position of the vehicle and destination information that indicates a destination, the traffic information distributing apparatus comprises a route searching unit that searches for a route, based on the vehicle position information and the destination information, the basic distribution range setting unit sets the basic distribution range in a forward direction, in terms of a traveling direction of the vehicle, of the current position of the vehicle, and in a case where a surrounding area of the current position of the vehicle contains as many drivable links as, or more drivable links than, a predetermined number, the distribution range changing unit sets the changed distribution range so that the surrounding area of the current position of the vehicle is included in the changed distribution range.

7. The traffic information distributing apparatus according to claim 4, wherein the distribution range changing unit includes a traffic obstruction judging unit that judges whether or not there is any traffic obstruction within the basic distribution range, and in a case where the traffic obstruction judging unit has judged that there is a traffic obstruction within the basic distribution range, the distribution range changing unit sets the changed distribution range by enlarging the basic distribution range.

8. The traffic information distributing apparatus according to claim 1, further comprising:

a search criterion receiving unit that receives a search criterion used for searching for a route, from the navigation apparatus installed in a vehicle;

a distribution range setting unit that sets a distribution range that serves as a distribution target of the traffic information, based on the search criterion, and wherein the traffic information extracting unit extracts the traffic information that corresponds to the road type category for the set distribution range.

* * * * *